US006402589B1

(12) United States Patent
Inaba et al.

(10) Patent No.: US 6,402,589 B1
(45) Date of Patent: Jun. 11, 2002

(54) WAFER GRINDER AND METHOD OF DETECTING GRINDING AMOUNT

(75) Inventors: Takao Inaba; Minoru Numoto; Kenji Sakai, all of Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 0 days.

(21) Appl. No.: 09/581,797

(22) PCT Filed: Oct. 15, 1999

(86) PCT No.: PCT/JP99/05714

§ 371 (c)(1),
(2), (4) Date: Jun. 15, 2000

(87) PCT Pub. No.: WO00/23228

PCT Pub. Date: Apr. 27, 2000

(30) Foreign Application Priority Data

Oct. 16, 1998 (JP) ..... 10-295719
Oct. 16, 1998 (JP) ..... 10-295755

(51) Int. Cl.[7] ..... B24B 49/00; B24B 51/00; B24B 1/00

(52) U.S. Cl. ..... 451/5; 451/7; 451/9; 451/10; 451/41; 451/53; 451/59; 451/288

(58) Field of Search ..... 451/5, 7, 8, 9, 451/10, 11, 36, 41, 53, 59, 63, 285, 286, 287, 288, 290

(56) References Cited

U.S. PATENT DOCUMENTS 5,643,044 A * 7/1997 Lund ..... 451/5
6,004,187 A * 12/1999 Nyui et al. ..... 451/5
6,159,073 A * 12/2000 Wiswesser et al. ..... 451/6
6,261,152 B1 * 7/2001 Aiyer ..... 451/6

FOREIGN PATENT DOCUMENTS

| | | |
|---|---|---|
| EP | 0 806 266 | 11/1997 |
| EP | 0 819 500 | 1/1998 |
| EP | 0 868 975 | 10/1998 |
| JP | 51-90095 | 8/1976 |
| JP | 62-257742 | 11/1987 |
| JP | 64 45568 | 2/1989 |
| JP | 1-188265 | 7/1989 |
| JP | 4-244371 | 9/1992 |
| JP | 6-79618 | 3/1994 |
| JP | 6-270053 | 9/1994 |
| JP | 8-229808 | 9/1996 |
| JP | 8-288245 | 11/1996 |
| JP | 10-44035 | 2/1998 |
| JP | 10-175161 | 6/1998 |
| JP | 10-230454 | 9/1998 |
| JP | 11-198025 | 7/1999 |
| JP | 11-347918 | 12/1999 |

* cited by examiner

*Primary Examiner*—Timothy V. Eley
(74) *Attorney, Agent, or Firm*—Christie, Parker & Hale, LLP

(57) ABSTRACT

The present invention provides a wafer polishing apparatus capable of controlling the polishing quantity accurately. The wafer polishing apparatus comprises a rotatable polishing stool with a polishing cloth, a carrier for bringing a wafer into contact with the polishing cloth under a predetermined pressure, a pad arranged around the wafer in such a manner as to contact the polishing cloth under a predetermined pressure, a detector for detecting the change of the relative positions of the back of the wafer or the carrier and the pad, and a control unit for controlling the polishing operation in accordance with the polishing quantity computed from the detection signal of the detector, wherein an operating unit includes a sampling unit (82) for sampling the detection signal of the detector with such a sampling period that the number of times sampled per rotation of the polishing stool is plural, a moving average calculating unit (84) for calculating the moving average data by averaging the sampling data in the number equal to an integer multiple of the number of times sampled per rotation, and a polishing quantity computing unit (85) for computing the polishing quantity from the moving average data.

19 Claims, 17 Drawing Sheets

WAFER GRINDER AND METHOD OF DETECTING GRINDING AMOUNT

TECHNICAL FIELD

The present invention relates to a wafer polishing apparatus and a wafer polishing quantity detection method or, in particular, to a wafer polishing apparatus and a wafer polishing quantity detection method based on the chemical mechanical polishing (CMP) process used for flattening the surface of a wafer during the process of forming an IC pattern thereon.

In recent years, the IC has been further miniaturized and IC patterns have been formed over a multiplicity of layers. Some unevenness unavoidably occurs in the surface of a layer formed with a pattern. In the prior art, the next pattern is formed directly on such an uneven surface. With the increase in the number of layers, however, the reduced size of line widths makes it difficult to form a superior pattern, often leading to a defect. In view of this, a practice prevails in that the surface formed with a pattern is polished to a flat surface followed by forming the pattern of the next layer. Also, a metal layer for connecting the layers is formed by forming a hole and then plating, and the metal layer on the surface is removed by polishing while leaving intact the portion of the metal layer corresponding to the hole. For polishing the wafer during the process of forming the IC pattern in this way, a wafer polishing apparatus (CMP apparatus) based on the CMP method is used.

BACKGROUND ART

FIGS. 1A and 1B are diagrams for explaining the machining process using the CMP method in the fabrication of an IC. FIG. 1A shows the process of flattening by polishing the surface of a layer insulating film, and FIG. 1B shows the process of polishing the surface so that only the metal layer corresponding to the hole portion is left intact. In the case where the layer insulating film 3 is formed after forming a pattern 2 of a metal layer on a substrate 1, the portion of the pattern 2 is higher than the other portions, thereby causing an unevenness in the surface. In view of this, the surface is polished with the CMP apparatus into the state, as shown on the right side, and then the next pattern is formed. Also, when forming a metal layer for connecting the layers, a connecting hole is formed on the pattern 2 of the lower layer as shown in FIG. 1B, after which the metal layer 4 is formed over the entire surface by plating or the like. After that, the surface is polished until the metal layer 4 on the surface is entirely removed by the CMP apparatus.

FIG. 2 is a diagram schematically showing a basic configuration of the CMP apparatus. As shown in FIG. 2, the CMP apparatus includes a polishing stool 11 and a wafer holding head 20. An elastic polishing cloth 14 is attached on the surface of the polishing stool 11. The polishing stool 11 is coupled to a motor 13 through a spindle 12 and adapted to rotate in the direction of arrow. A slurry providing an abrasive is supplied on the polishing cloth 14 of the rotating polishing stool 11 from a nozzle not shown. The polishing cloth 14 may be formed with a groove for facilitating the supply of the slurry to the contact surface with the wafer. The wafer holding head 20 holds the wafer to be polished, and rotates while pressing the wafer against the polishing cloth 14 under a predetermined pressure. As a result, the surface of the wafer held is polished. Although FIG. 2 shows the case in which only one wafer holding head 20 is provided, a plurality of wafer holding heads 20 may be provided on a single polishing stool.

Various types of wafer holding mechanisms are available for the wafer holding head 20. For example, Japanese Unexamined Patent Publications (Kokai) No. 6-79618, No. 8-229808 and No. 10-175161 disclose a wafer polishing apparatus in which a wafer is held by being closely attached to a carrier by adsorption or the like means and the carrier is pushed thereby to press the wafer against the polishing cloth. On the other hand, Japanese Unexamined Patent Publication (Kokai) No. 51-90095 discloses a lapping apparatus, not a CMP apparatus, in which a wafer is held by being attached to a carrier with an adhesive or two-side tape or the like and the carrier is pushed to press the wafer against the polishing cloth. Such apparatuses can securely hold the wafer being polished, but in the presence of dust or the like foreign matter between the carrier and the back of the wafer, the pressure of the carrier cannot be uniformly transmitted over the entire wafer surface, thereby making it difficult to polish the whole wafer surface uniformly. In order to solve this problem, Japanese Unexamined Patent Publication (Kokai) No. 1-188265 discloses a lapping apparatus in which a carrier includes an air outlet for applying an air pressure from the back of the wafer and by thus pressing the wafer against the stool, the surface is polished while at the same time keeping the carrier and the wafer out of contact with each other. Also, the present applicant has disclosed in Japanese Patent Publication (Kokai) No. 9-138925 corresponding published application JP-A-11-347918 and U.S. application Ser. No. 09/053,062, a wafer polishing apparatus comprising an air bag for pressing the carrier with an air outlet thereby to facilitate the adjustment of the pressure of the wafer against the polishing cloth in contactless manner.

In the CMP apparatus, the surface of the IC pattern is required to be polished accurately by a predetermined quantity. Various methods have been proposed for controlling the polishing quantity accurately. A method capable of most accurately controlling the polishing quantity is a process control method in which the polishing work is conducted little by little while measuring the polishing quantity. According to this method, in order to secure the required film thickness, the remaining film thickness is measured after every polishing session of several seconds, and if there is any shortage of the polishing quantity, the polishing is repeated. This method, however, is very low in productivity and encounters the problem of difficulty of application to mass production. Another method of controlling the polishing quantity is by controlling the time while stabilizing the polishing process. Due to the variations of the polishing process, however, it is difficult to control the polishing quantity with high accuracy. Also, the use of a dummy wafer for monitoring the relation between the polishing time and the polishing quantity poses the problem of a reduced throughput. Other methods that have thus far been proposed include a method for detecting the capacity with the metal wiring layer under an oxide film and a method in which the torque change is detected taking advantage of the fact that the torque required for polishing varies with the type of the layer. Under the circumstances, however, these methods fail to be satisfactory solutions as the scope of application is limited and the detection accuracy is not sufficiently high.

It is therefore desirable to directly measure the thickness of the wafer being polished and to calculate and control the polishing quantity based on the change in the thickness. Nevertheless, it is difficult to measure the wafer thickness during the polishing operation. Various methods have thus been proposed for measuring the quantity corresponding to the change in the wafer thickness. The patent publication No. 51-90095 described above, for example, discloses a lapping apparatus in which one of the parts constituting a detector such as an electric micrometer is mounted in a sample holder arranged on a lapping stool and the other parts are mounted in a sample holding frame with the work attached thereto thereby to detect the change in the thickness of the work. The sample holder, like the work, is in contact with the lapping stool, and the polishing quantity can be detected by detecting the displacement of the sample holding frame. In this lapping apparatus, however, the sample holding frame is urged by the sample holder in such a manner as to be pressed against the lapping stool, and therefore the force is developed between the sample holder and the sample holding frame with the rotation of the lapping stool or the sample holding frame, thereby posing the problem that the pressure under which the work is pressed against the lapping stool undergoes a fluctuation. Especially, in the case of the CMP apparatus having an elastic polishing cloth on the surface of the stool, the problem is the large vibration of the sample holder caused by the rotation.

In order to obviate the problems mentioned above, Japanese Unexamined Patent Publications (Kokai) No. 8-229808 and No. 10-175161 described above disclose a configuration in which a polishing surface adjusting ring is arranged around the wafer and the fluctuation of the polishing cloth within the ring is reduced to suppress the polishing pressure unevenly distributed to the edge of the wafer. Especially, Japanese Unexamined Patent Publication (Kokai) No. 10-175161 discloses a CMP apparatus in which some parts constituting a detector such as an electric micrometer are arranged on a carrier for holding the wafer and the other parts are arranged on a member adapted for displacement in contact with the polishing cloth between the wafer and the polishing surface adjusting ring thereby to detect the work thickness change. With this apparatus, the force developed between the members displaced by contact between the carrier and the polishing cloth can be substantially ignored. Also, the members are in contact with the polishing cloth only within the polishing surface adjusting ring where the fluctuation is comparatively small. Therefore, an accurate measurement should be possible. In this apparatus, however, the periodic fluctuation developed with the rotation of the wafer holding head and the carrier has a direct effect on the measurement, and therefore the signal is actually difficult to process.

Japanese Unexamined Patent Publication (Kokai) No. 11-198025 corresponding to U.S. application Ser. No. 09/112,287 discloses a wafer polishing apparatus in which an arm passing through the central portion of a carrier is arranged on a polishing surface adjusting ring or on an annular pad inside the polishing surface adjusting ring, and a detector is arranged for detecting the relative vertical displacement between the arm and the central portion of the carrier, thereby reducing the effect of the periodic fluctuation caused by the rotation of the wafer holding head and the carrier.

Even in the case where the change in wafer thickness is detected by the wafer polishing apparatus disclosed in Japanese Unexamined Patent Publication (Kokai) No. 11-198025, the detection signal undergoes such a sharp fluctuation that it is very difficult to control the apparatus to calculate a correct polishing quantity from this detection signal and to polish only the required polishing quantity.

Also, the actual implementation of this method generates heat by polishing in the portions of the polishing surface adjusting ring and a reference pad in contact with the polishing cloth, thereby changing the temperature distribution in these parts. As a result, the relative positions of the portions supporting the detector or in contact with the detector are changed by thermal expansion, thereby adversely affecting the detection signal. In order to remove this effect, a model indicating the relation between the detection signal and the actual polishing quantity is produced in advance, and in accordance with the model, the detection signal is corrected, so that when the value of the corrected detection signal changes by a predetermined value, it is determined that the polishing is accomplished by a designated quantity.

Another method of controlling the polishing quantity is to control the time by stabilizing the polishing process. In this method, a model indicating the relation between the polishing time and the polishing quantity is produced in advance, and in accordance with this model, the polishing time required for polishing a designated polishing quantity is calculated and the actual polishing work is conducted for the particular polishing time. This method is simple and involves a comparatively accurate polishing quantity as far as the polishing process is stable.

In the above-mentioned method of controlling the time by producing a model indicating the relation between the polishing time and the polishing quantity and the method of correcting by detecting a quantity corresponding to the change in wafer thickness, a model is produced in advance by polishing a reference wafer and measuring the change in wafer thickness before and after the polishing work. In spite of this, the fluctuations of various factors including the temperature and the wear of the polishing cloth makes it impossible to conduct the polishing work as according to the model, thereby leading to the problem of an error in the polishing quantity.

In order to solve these problems, a dummy wafer is polished at the same time or the dummy wafer is periodically polished to correct a model. The use of a dummy wafer, however, poses the problem of a correspondingly lower throughput.

DISCLOSURE OF THE INVENTION

The present invention is intended to solve these problems, and the object thereof is to provide a wafer polishing apparatus in which the polishing quantity can be accurately controlled.

In order to realize the object described above, according to a first aspect of the invention, there is provided a wafer polishing apparatus and a wafer polishing method therefor, in which the detection signal of a detector is sampled with such a sampling period that the number of times samples are taken per rotation of a polishing stool is plural, the sampling data in a number an integer multiple of the number of times sampled per rotation is averaged to calculate the moving average data, whereby the polishing quantity is calculated.

Specifically, a wafer polishing apparatus according to the first aspect of the invention comprises a rotatable polishing stool with a polishing cloth arranged on the surface thereof, a carrier rotated about a rotational axis different from and parallel to the rotational axis of the polishing stool thereby to bring the wafer into contact with the polishing cloth under a predetermined pressure, a pad arranged around the wafer in such a manner as to contact the polishing cloth under a predetermined pressure, a detector for detecting the change in the relative positions of the back surface of the wafer or the carrier and the pad, an operating unit for computing the polishing quantity by processing the detection signal of the detector, and a control unit for controlling the polishing operation in accordance with the polishing quantity computed, characterized in that the operating unit includes a sampling unit for sampling the detection signal of the detector with such a sampling period that the number of times sampled per rotation of the polishing stool is plural, a moving average calculating unit for calculating the moving average data by averaging the sampling data in the number an integer multiple of the number of times sampled per rotation, and a polishing quantity computing unit for computing the polishing quantity from the moving average data.

In the wafer polishing apparatus, the polishing stool and the carrier (wafer holding head) are rotated with predetermined periods, respectively. The polishing stool and the carrier have their respective slight inclination or undulation in their motion. Even in the case where the wafer has a constant thickness, therefore, the detection signal of the detector changes with the rotational period of the polishing stool and the carrier. Specifically, the detection signal changes with a period equal to the least common multiple of the two periods. As far as the two rotational periods is the same, therefore, the same change is repeated with the particular period. In the case where one rotational period is an integer multiple of the other rotational period, on the other hand, the change is repeated with the larger period, while in the case where the two rotational periods are slightly different or an integer multiple of one period is slightly different from the other period, then the change is undulated. Normally, the polishing stool and the carrier are set to the same rotational period, or the rotational period of the polishing stool is longer than that of the carrier and set to an integer multiple of the latter, and therefore the same change is repeated for each rotation of the polishing stool. In the wafer polishing apparatus and the wafer polishing method therefor according to the invention, the detection signal is sampled a plurality of times per rotation of the polishing stool, and moving average data is calculated by averaging the sampling data in a number equal to an integer multiple of the number of times sampled per rotation, and therefore data substantially associated with the actual change of the wafer thickness, with little fluctuation, is obtained.

Even in the case where the moving average data are calculated as described above, however, the slurry is not stably supplied over the entire surface, heat begins to be generated by the polishing and data are not stabilized and fluctuate irregularly for a certain length of time from the polishing start. In view of this, the data are not used before the lapse of a predetermined time from the polishing start, and the polishing quantity is desirably computed from the data obtained after the lapse of the predetermined time. Further, the generation of heat by the polishing continues as long as the polishing operation. Therefore, the temperature distribution of various parts including the carrier, the pad and the arm supporting the detector is changed thereby to change the thermal expansion, so that the relative position of the detector is changed. As a result, the detection signal undergoes a change. Also, the detector itself has a temperature characteristic and the detection signal changes with the change in the temperature of the detector. The change in the detection signal due to these factors occurs continuously from the start of the polishing process. In view of this, the polishing quantity computing unit desirably includes a correction data storage unit for storing the correction data calculated from the polishing quantity computed by polishing a sample wafer and the practical measured values of the thickness of the sample wafer taken by different measuring tools before and after the polishing, and a correcting unit for correcting the polishing quantity computed in the polishing quantity computing unit based on the correction data and outputting the resulting polishing quantity.

The first aspect of the invention, though effective in a polishing apparatus for polishing a wafer fixed on a carrier, is also applicable to a configuration in which a pressure fluid layer forming unit for forming a pressure fluid layer at the back of the wafer is arranged on the carrier and the wafer is pressed against the polishing cloth by the pressure fluid layer.

In the wafer polishing apparatus having a configuration that the wafer is pressed against the polishing cloth by the pressure fluid layer, the following phenomenon has been found to occur during the process of polishing off the metal layer formed on the insulating material layer as shown in FIG. 1B. Specifically, when the metal layer is removed to such an extent that the insulating material layer is exposed in a part of the surface, the detection signal sharply decreases, and the detection signal increases again at the time point when the whole metal layer is removed from the surface. In the case of polishing off the metal layer formed on the insulating material layer, therefore, the time point at which the surface metal layer is removed can be determined by observing the change in the detection signal. Therefore, the metal layer can be accurately removed as shown in FIG. 1B, for example, by polishing a little longer than the time point when the detection signal begins to increase again after the sharp decline.

As described above, a temperature distribution occurs at various parts due to the polishing heat. Desirably, therefore, a temperature sensor for detecting the temperature of the neighborhood of the detector is provided to make a correction according to the temperature characteristic of the detector. Also, another temperature sensor is provided for detecting at at least some of the members between the portion where the relative positions are detected by the detector and the back of the wafer or the portion of the carrier facing the wafer. Still another temperature sensor is provided for detecting the temperature of at least some of the members between the portion where the relative positions are detected by the detector and the portion of the pad facing the polishing cloth. Based on the temperatures detected by these temperature sensors, the difference in thermal expansion between the related portions is calculated and the detection signal is corrected by the difference of the thermal expansion, thereby improving the detection accuracy.

The wafer holding head for holding the carrier rotates. For transmitting the detection signal of the detector and the detection signals of the temperature sensors, therefore, a slip ring is desirably provided for accommodating the transmission path of the electrical signal in the rotational shaft of the wafer holding head. At the same time, an analog processing circuit for the detection signal and an A/D conversion circuit for converting the output of the analog processing circuit into digital data are desirably arranged on the wafer holding head, so that the digital data are transmitted to an external data processing circuit through the slip ring.

According to a second aspect of the invention, there is provided a wafer polishing apparatus in which the actual polishing quantity of a normal wafer to be polished is measured and this practical measured value is compared with a predetermined polishing quantity, so that a model is corrected by the difference whenever required.

Specifically, the wafer polishing apparatus according to the second aspect of the invention comprises a rotatable polishing stool with a polishing cloth arranged on the surface thereof, a wafer holding head for holding a wafer and rotated while pressing the wafer surface against the polishing cloth, and a control unit for controlling the operation in such a manner as to perform the polishing operation by a designated polishing quantity data in accordance with a polishing model, characterized by further comprising a polishing quantity measuring unit for taking the practical measured value of the polishing quantity of the wafer polished, and a polishing model correcting unit for correcting the polishing model in accordance with the difference the practical measured value of the polishing quantity taken by the polishing quantity measuring unit and the polishing quantity data.

According to this invention, a model is corrected as required according to the error of the polishing quantity of not a dummy wafer but a normal wafer, and therefore the polishing quantity can be controlled with an optimum model at a particular time point without reducing the throughput. The polishing quantity can thus be controlled with a high accuracy.

In a polishing quantity measuring unit of one type including a wafer thickness measuring tool for measuring the thickness of a wafer, the practical measured value of the polishing quantity is calculated from the difference in wafer thickness before and after polishing. In a polishing quantity measuring unit of another type including a thickness measuring tool for detecting the thickness of an oxide insulating film formed on the wafer, the practical measured value of the polishing quantity is calculated from the difference in the thickness of the oxide insulating film before and after polishing.

The polishing models include the one indicating the change in the polishing quantity of the wafer with respect to the polishing time as described above, and the one for correcting the output of a displacement measuring tool produced from the practical measured value and the output of the displacement measuring tool used for detecting the change in vertical relative positions of the surface of the polishing cloth and the back of the wafer or the wafer holding head.

In one correction method, a polishing model is corrected in such a manner as to acquire an intermediate value between the practical measured value of the polishing quantity and the polishing quantity data. In another conceivable method, the correction is effected when the difference increases between the practical measured value of the polishing quantity and the polishing quantity data.

BEST MODE FOR CARRYING OUT THE INVENTION

Figure 3:
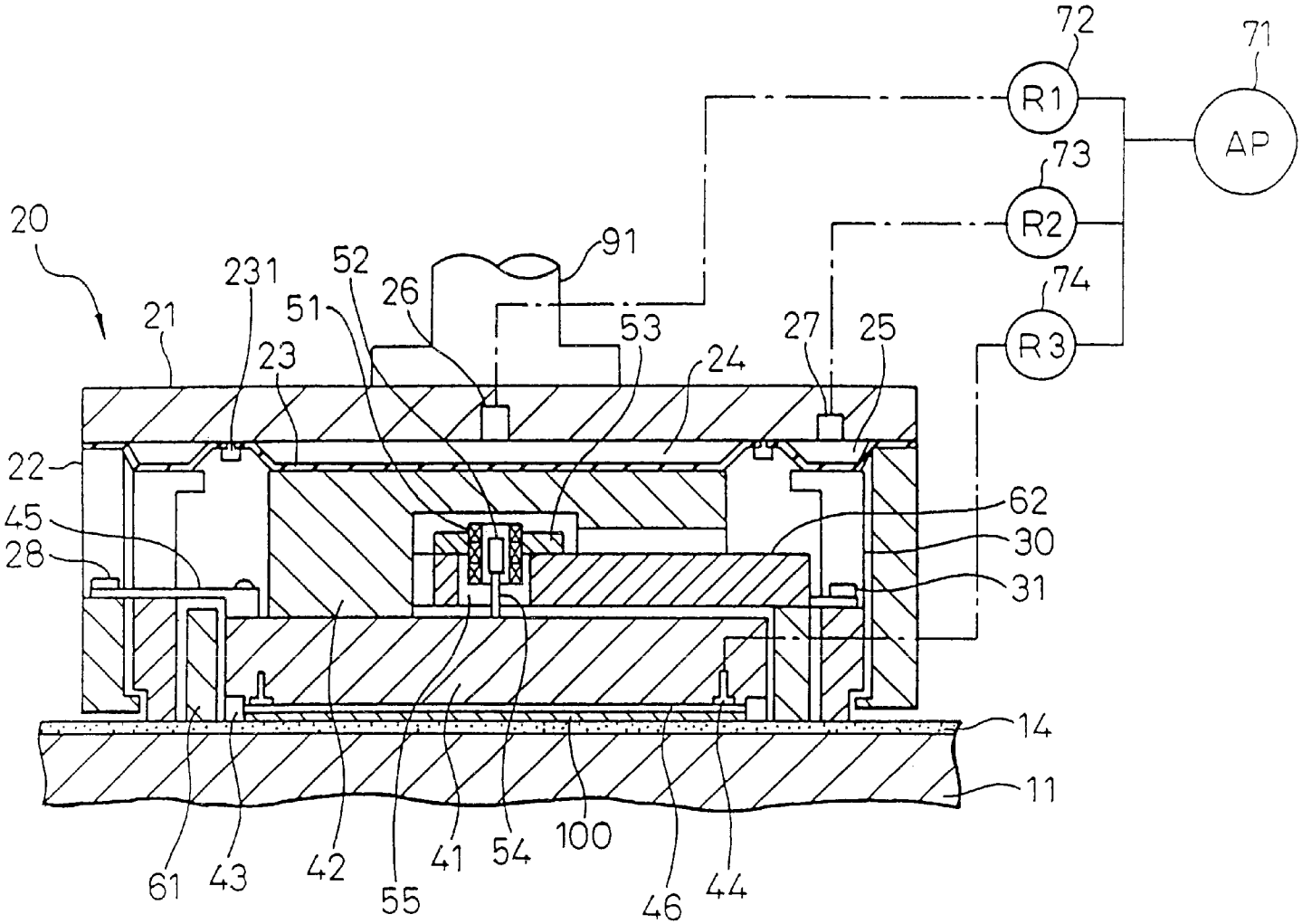
FIG. 3 is a sectional view of a wafer holding head of a wafer polishing apparatus according to a first embodiment of the invention.

FIG. 3 is a sectional view showing a wafer holding head according to an embodiment of the invention.

As shown in FIG. 3, a wafer holding head 20 includes a head body 21, a guide ring 22, a rubber sheet 23, a polishing surface adjusting ring 30, a carrier member 41, a retainer ring 43, a reference pad ring 61, an arm 62 mounted on the reference pad ring 61, a bobbin 51 constituting a differential transformer and a core (iron core) 52.

The head body 21 is in the form of disk, and with a rotational shaft 91 fixed on the upper surface thereof, is rotated by a motor not shown. Also, the head body 21 is formed with gas supply lines 26, 27. The gas supply lines 26, 27 extend to the exterior of the wafer holding head 20 as shown, and through regulators 72, 73, are connected to a gas pump 71.

The carrier member 41 is substantially cylindrical in shape and arranged under the head body 21. A member 42 is mounted on the carrier member 41 in such a manner as to avoid an arm 62. A core 52 constituting a differential transformer is supported by a pole 54 at the center of the upper surface of the carrier member 41. A recess 46 is formed in the lower surface of the carrier member 41 and has a wafer 100 held therein. A retainer ring 43 is arranged around the recess 46 for preventing the wafer 100 from falling out and thus restricting the position of the wafer 100. Further, a gas supply line 44 is formed along the peripheral portion of the lower surface of the carrier member 41. The gas supply line 44 extends to the exterior of the wafer holding head as shown and, through a regulator 74, is connected to a gas pump 71. When a gas is supplied to the gas supply line 44, a pressure gas layer is formed in the recess 46, and through this pressure gas layer, the wafer 100 is pressed against the polishing cloth 14. Since a gas of the same pressure is blown out of the gas supply line 44, no gas flow is formed toward the center, but a uniform pressure of the pressure gas layer is maintained in the gas supply line 44. Though not shown, the carrier member 41 moves on the polishing cloth 14 while picking up and holding the unpolished wafer from a loader, and returns the polished wafer to an unloader. For this purpose, a suction gas intake path and a gas pump are provided, though not shown, for temporarily adsorbing the wafer.

The reference pad ring 61 is an annular member arranged on the outside of the carrier member 41 and has an arm 62 fixed at three points. A hole 55 is formed at the center of the arm 62, i.e. the portion of the wafer 100 on the center axis. A bobbin 51 constituting a differential transformer is fixed by a mounting member 52 in such a manner as to be inserted in the hole 55. The core 52 is located in the bobbin 51 and makes up the differential transformer.

The polishing surface adjusting ring 30 is an annular member located on the outside of the reference pad ring 61. Further, a guide ring 22 fixed under the head body 21 is arranged on the outside of the polishing surface adjusting ring 30, and a rubber sheet 23 is fixedly held in the gap with the guide ring 22.

The rubber sheet 23 is formed in the shape of disk with uniform thickness and fixed on the head body 21 by an annular fitting 231 and a guide ring 22. A circular first gas chamber (air bag) 24 and an annular second gas chamber 25 around the first gas chamber 24 are provided. The gas supply lines 26, 27 are connected to a first gas chamber 24 and a second gas chamber 25, respectively. By supplying a gas to the gas supply lines 26 and 27, the first gas chamber 24 and the second gas chamber 25 are expanded, respectively. The first gas chamber 24 is located on the member 42 fixed on the carrier member 41. Upon the increase of the pressure of the gas supplied to gas supply line 26, the first gas chamber 24 expands and the carrier member 41 is urged downward. This urging force increases the pressure of the wafer 100 through the pressure gas layer in the recess 46. Thus, by adjusting the pressure of the gas supplied to the gas supply line 26, the pressure of the wafer 100 against the polishing cloth 14 can be set. Also, the second gas chamber 25 is located above the polishing surface adjusting ring 30, and with the increase in the pressure of the gas supplied to the gas supply line 27, the second gas chamber 25 expands so that the polishing surface adjusting ring 30 is pressed against the polishing cloth 14. Thus, by adjusting the pressure of the gas supplied to the gas supply line 27, the pressure of the polishing surface adjusting ring 30 applied to the polishing cloth 14 can be set. According to this embodiment, the reference pad ring 61 is brought into contact with the polishing cloth 14 by its own, including the arm 62, weight. Alternatively, like the polishing surface adjusting ring 30, the reference pad ring 61 can be pressed against the polishing cloth 14 under a predetermined pressure utilizing the air bag formed by a rubber sheet.

The guide ring 22 is fixed on the head body 21. The carrier member 41, the reference pad ring 61 and the polishing surface adjusting ring 30, however, are not fixed. The carrier member 41 is restricted in location and movable in a narrow range with respect to the guide ring 22 by three coupling members 45 fixed on the carrier member 41 and a pin 28 arranged on the guide ring 22. In similar manner, the polishing surface adjusting ring 30 is restricted in location with respect to the guide ring 22 by a coupling member fixed on the polishing surface adjusting ring 30 and a pin arranged on the guide ring 22. The reference pad ring 61 is restricted in location with respect to the polishing surface adjusting ring 30 by a pin 31 arranged on the polishing surface adjusting ring 30.

Figure 4:
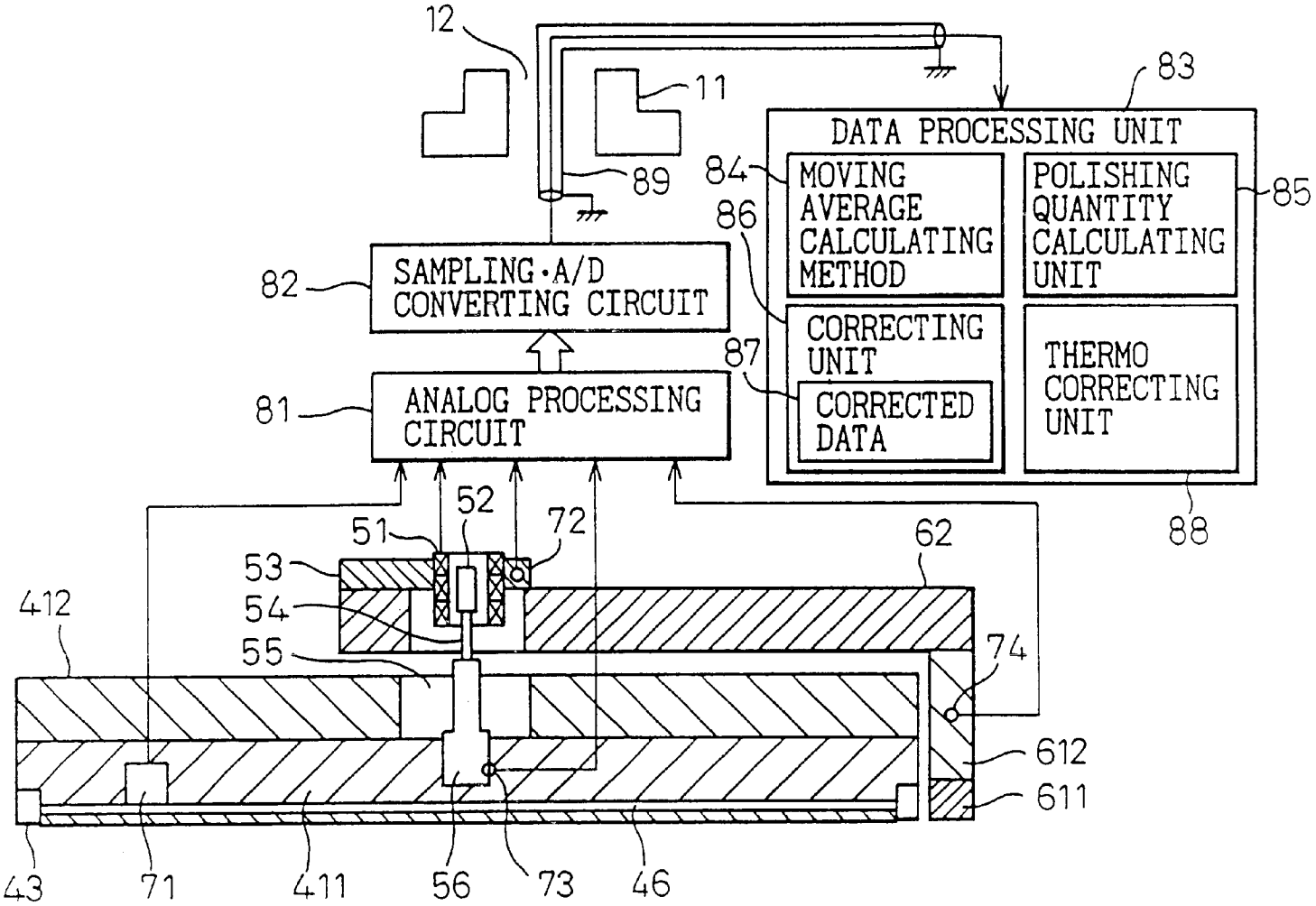
FIG. 4 is a diagram showing a configuration of the portions of the wafer polishing apparatus according to the first embodiment which are related to measurement of relative positions and the portions related to electrical signals.

FIG. 4 is a diagram showing a configuration of the parts related to the measurement of relative positions and the parts related to the electrical signals in the first embodiment. As shown in FIG. 4, the wafer holding head 20 includes a bobbin 51 and a core 52 making up an electric micrometer. Further, thermistors 72 to 74 are provided at the shown positions for detecting the temperature. Also, a sensor 71 for detecting the thickness of the pressure gas layer in the recess 46 is provided. The sensor 71 is an eddy current sensor, for example. Once the gas supplied to the gas supply line 44 is set at a predetermined pressure, a substantially fixed thickness of the pressure gas layer is obtained, thereby making it possible to eliminate the sensor 71.

The bobbin 51 making up the electric micrometer is fixed on an arm 62, and the core 52 is fixed on the carrier member 41. The displacement of the core 52 with respect to the bobbin 51, i.e. the output change of the electric micrometer indicates the difference in position between the front surface and back surface of the wafer 100, i.e. the thickness change of the wafer 100.

Actually, however, the pressure fluid layer exists between the carrier member 41 and the back of the wafer 100, and therefore, the thickness change of the wafer 100 is obtained by subtracting the change of the pressure fluid layer. This change quantity is the polishing quantity.

The bobbin 51 is fixed on the arm 62, and separated from the surface of the polishing cloth 14 by the distance corresponding to the reference pad ring 61 and the arm 62. Thus, with the thermal expansion or contraction of the reference pad ring 61 and the arm 62, the amount of expansion or contraction, as the case may be, constitutes an error of the polishing quantity. In similar fashion, the core 52 is fixed on the pole 54, and is separated from the bottom surface of the carrier member 41 by the distance corresponding to the carrier 41 and the member 56 and the pole 54 fixed thereon. The amount of the thermal expansion or contraction of these members constitutes an error of the polishing quantity. During the polishing, the friction generates the heat, which increases the temperature of these parts. For the purpose of high-accuracy detection of the polishing quantity, therefore, the error due to this temperature rise cannot be neglected. In view of this, according to this embodiment, the parts for which the thermal expansion has an effect on the detection result use a material having a small coefficient of thermal expansion such as amber. The portion in contact with the polishing cloth 14 is required to be configured with ceramic, and therefore the member 411 corresponding to the carrier member 41 is configured with ceramic, while the central portion is embedded with a member 56 of amber, and the pole 54 is made of titanium, as shown in FIG. 4. Also, the lower portion 611 of the reference pad ring 61 in contact with the polishing cloth 14 is made of ceramic, and the upper portion 612 thereof is made of amber. The arm 62 is also made of amber. The coefficient of thermal expansion of amber is smaller by one order than that of ceramic. This configuration can considerably reduce the error attributable to thermal expansion.

For assuring the detection with higher accuracy, however, according to this embodiment, the actual temperature is detected and the error due to thermal expansion is corrected.

A thermistor 73 is arranged with the carrier member 411 and the amber member 56 to detect the temperature of the particular portion. Further, a thermistor 74 is arranged on the upper portion 612 of the reference pad ring made of an amber material to permit temperature measurement. From the length (in the direction perpendicular to the wafer), the coefficient of thermal expansion of the material and the detected temperature of each part, the positional change of the bobbin 51 and the core 52 due to the thermal expansion is calculated, and the detection result is corrected by the calculation, thereby reducing the error.

The detection signal of the electric micrometer configured with the bobbin 51 and the core 52 also changes with temperature. The member 53 on which the bobbin 51 is fixed includes a thermistor 72 for detecting the temperature of the bobbin 51, which temperature is corrected based on the temperature characteristic of the electric micrometer measured in advance.

The electric micrometer, the sensor 71 and the thermistors 72 to 74 are provided on the portions rotated about the rotational shaft 91. In order to transmit the detection signal, the output signal of the sensor 71 and the signals of the thermistors 72 to 74 to external units, a slip ring is provided in the rotational shaft 91. The detection signal, the output signal of the sensor and the signals of the thermistors 72 to 74 are so small that they are easily affected by noise, etc. According to this invention, therefore, an analog processing circuit 81 for processing the detection signal, the output signal of the sensor 71 and the signals of the thermistors 72 to 74 and a sampling and A/D converting circuit 82 for sampling and converting the output of the analog processing circuit 81 into a digital signal are arranged in the wafer holding head 20, and the converted digital signal is transmitted through the slip ring to an external data processing unit 83. The data processing unit 83 is a computer, for example, and realizes, by software, the process of the detector temperature characteristic correcting unit 84 for correcting the temperature characteristic of the electric micrometer and the thermal expansion correcting unit 85 for correcting the error due to the thermal expansion.

Now, the signal processing and the data processing in the analog processing circuit 81, the sampling and A/D converting circuit 82 and the data processing unit 83 will be explained.

Figure 5A:
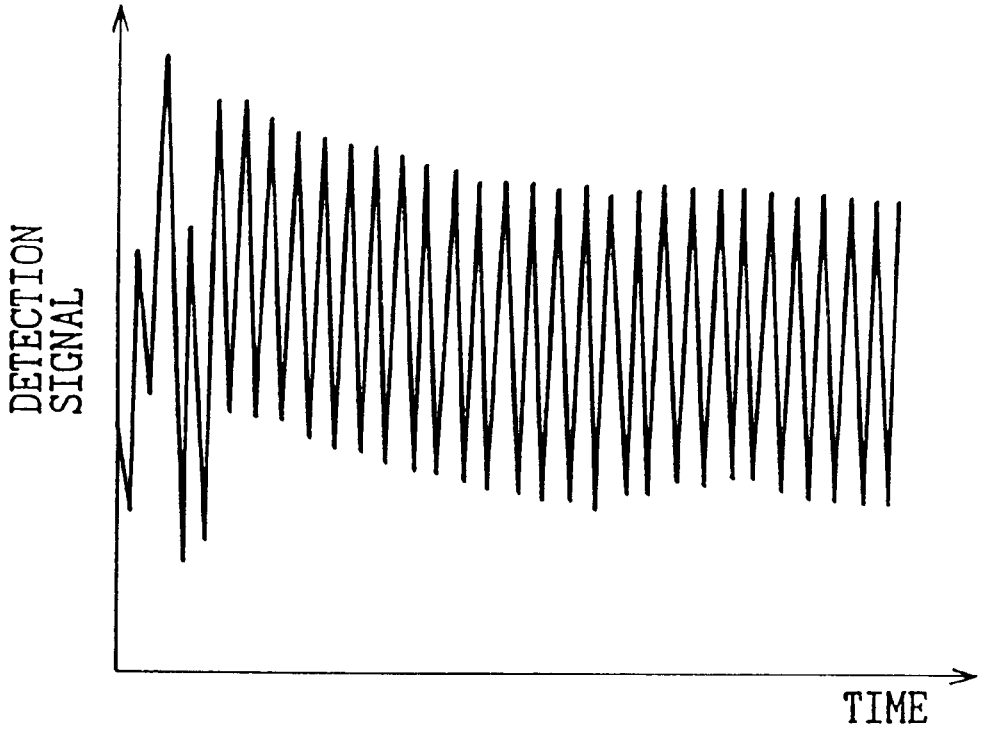
FIGS. 5A and 5B are diagrams showing the detection signal obtained in the first embodiment and the moving average data thereof.
Figure 5B:
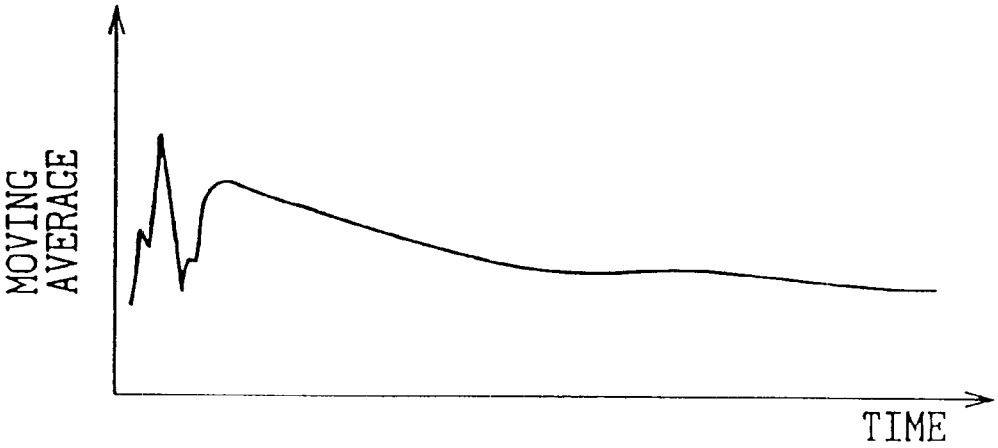

FIGS. 5A and 5B are diagrams showing a model of the detection signal of the electric micrometer actually produced during the polishing operation. As shown in FIG. 5A, the detection signal fluctuates considerably, and therefore it is necessary to process the detection signal for obtaining the data indicating the change in wafer thickness. The signal shown is an example for the case in which the polishing stool 11 and the wafer holding head 20 rotate with the same period while the detection signal considerably oscillates in rotational period. In view of this, according to this embodiment, the signal is sampled ten times per rotation of the polishing stool 11 by the sampling and A/D converting circuit 82, and the ten sampled data are averaged to calculate the moving average data as shown in FIG. 5B. Specifically, the first ten data are averaged as the first moving average data, the second to 11th data are averaged to produce the second moving average data, and so on. Therefore, the first detection result is obtained only after one rotation. Normally, the polishing stool 1 rotates at the speed of 30 to 120 rpm and requires about 2 minutes for polishing. There is no special problem, therefore, if the first data is obtained after one rotation. The determination as to whether the polishing process has ended or not, however, is required to be made taking into consideration that the data are those for one preceding rotation, i.e. that the polishing is advanced by one rotation. By the way, the moving average data can alternatively be calculated by averaging the data obtained by sampling twice or an integer multiple of times the number of times sampled per rotation.

Based on the moving average data calculated in the manner described above, the polishing quantity computing unit 85 of the data processing unit 83 calculates the polishing quantity.

Figure 1A:
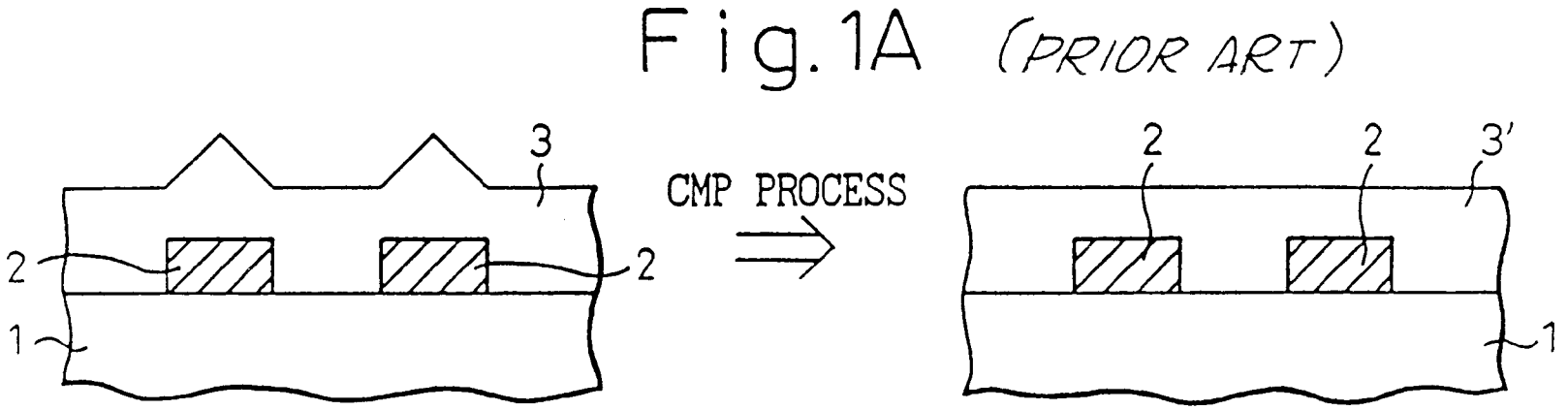
Fig. 1A (PRIOR ART)
FIGS. 1A and 1B are diagrams for explaining the processing using the CMP method in an IC fabrication process.
Figure 6A:
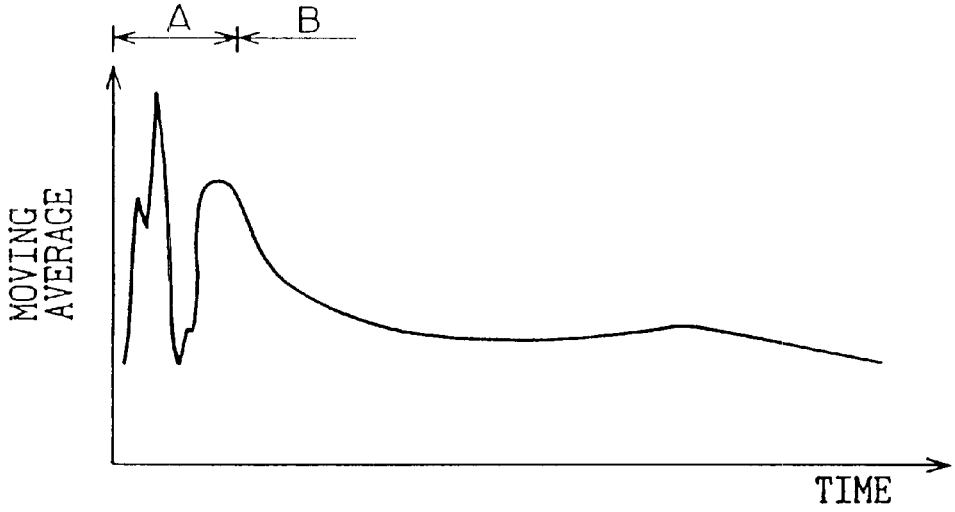
FIGS. 6A to 6C are diagrams showing an example of the change in the moving average data, the practical measured value of the thickness change and the correction data when polishing a polishing insulating material layer according to the first embodiment.
Figure 6B:
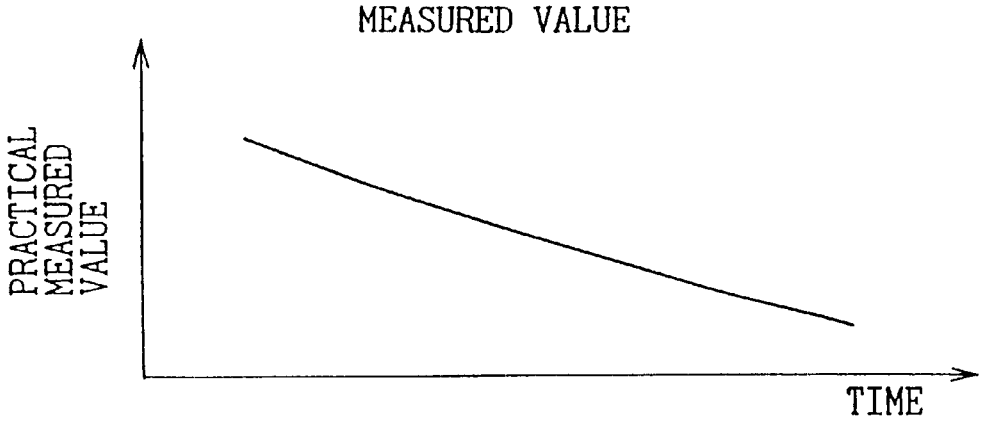
Figure 6C:
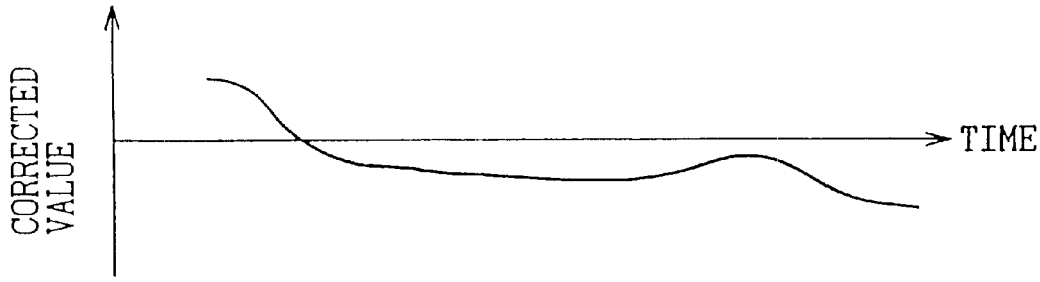

FIGS. 6A to 6C are diagrams showing the moving average obtained by polishing the insulating film material layer 3 as shown in FIG. 1A. As shown, during the period A from the start of polishing before the lapse of a predetermined time, the moving average undergoes sharp ups and downs. The moving average should not increase during the period when the polishing operation is going on. This fluctuation, therefore, is considered attributable to the probable fact that the slurry is not supplied stably over the whole surface and heat begins to be generated before a predetermined time length after start of polishing. This period is comparatively constant under the same polishing conditions, and after the lapse of this period, the moving average data are stabilized. According to this embodiment, therefore, the polishing quantity computing unit 85 does not use the data for the period A from the start of polishing but only the data for the period B to calculate the polishing quantity.

Further, assuming that, as a result of conducting the polishing operation under the conditions indicated by the data in FIG. 6A, the polishing operation is stopped after various lengths of polishing time and the thickness of the wafer or the insulating material layer is measured before and after polishing, the data as shown in FIG. 6A are indicated, and the practical measured value of the polishing quantity has been found to exhibit a change as shown in FIG. 6B. This difference is probably caused by the fact that heat is generated by polishing during the polishing operation and therefore the temperature distribution of the various parts including the carrier, the pad and the arm supporting the detector changes thereby to change the thermal expansion, resulting in the change in the relative position of the detector. The detector has its own temperature characteristic, and therefore a temperature change of part of the detector changes the detection signal. This difference between the practical measured value and the moving average data occurs in the same manner as far as the polishing conditions remain the same. In view of this, the correction value as shown in FIG. 6C is calculated by calculating the difference between FIGS. 6A and 6B, and stored in the corrected data storage unit 87 of the correcting unit 86. Then the correcting unit 86 calculates the corrected data by subtracting the above-mentioned corrected value from the polishing quantity calculated by the polishing quantity computing unit 85.

Figure 1B:
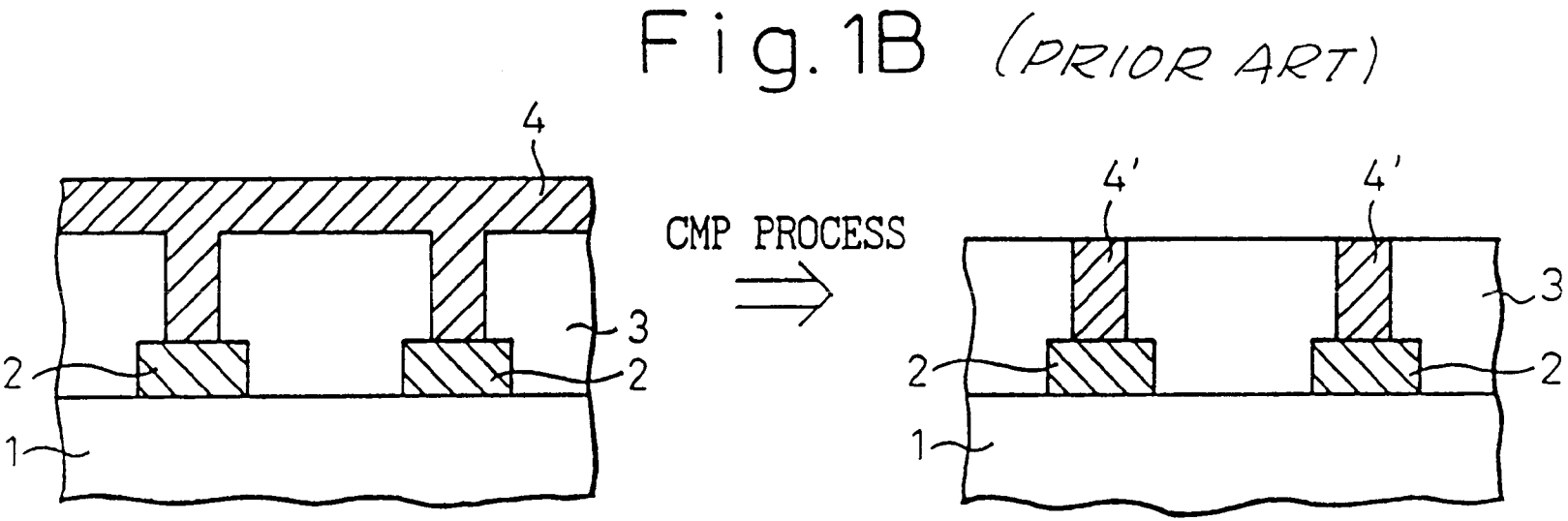
Fig. 1B (PRIOR ART)
Figure 2:
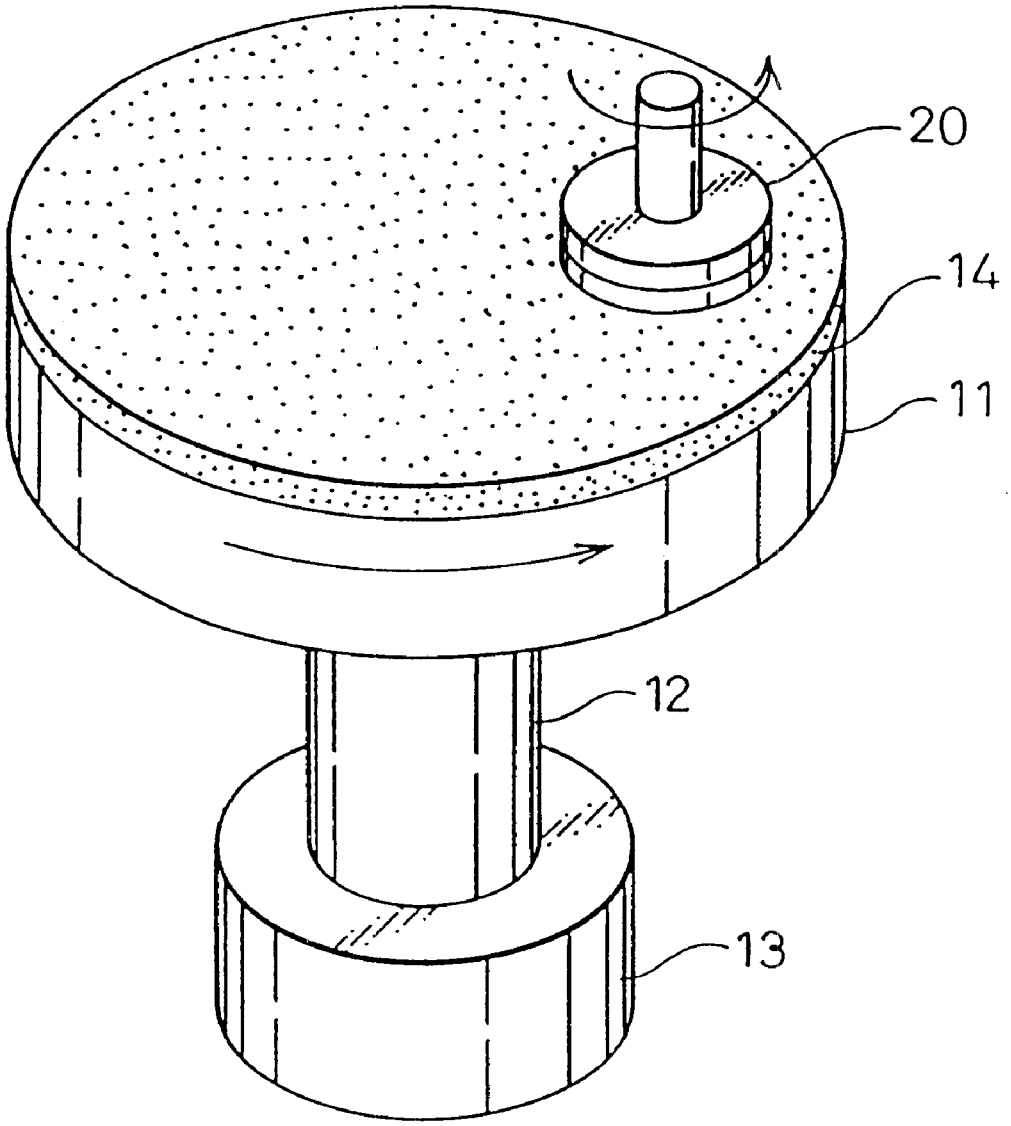
Fig.2 (PRIOR ART)
FIG. 2 is a diagram showing a model basic configuration of a wafer polishing apparatus.
Figure 7:
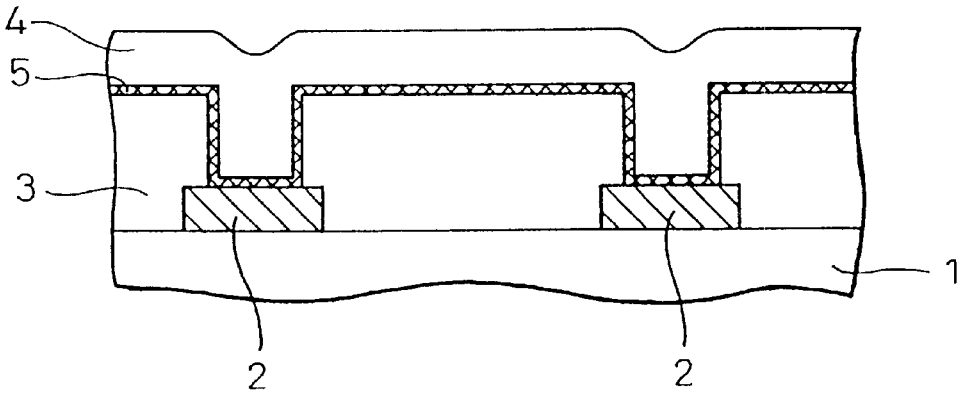
FIG. 7 is a diagram showing an example configuration of a metal layer to be polished.

This correction is applicable also to the case of polishing the metal layer as shown in FIG. 1B. Also, according to this embodiment, the observation of the moving average data with the metal layer polished shows a unique change. FIG. 7 is a diagram showing an example of an actual layer structure forming at least a layer connecting hole. An insulating material layer 3 is formed on a lower electrode layer 2, and at least a hole corresponding to a layer connecting hole is formed by photolithography and etching. Further, a very thin titanium nitride (TiN) layer 5 is formed thereon, on which a copper (Cu) layer 4 of a thickness required for filling the layer connecting hole is formed. When the wafer formed with this layer is polished, the moving average data is changed as shown in FIG. 8.

Figure 8:
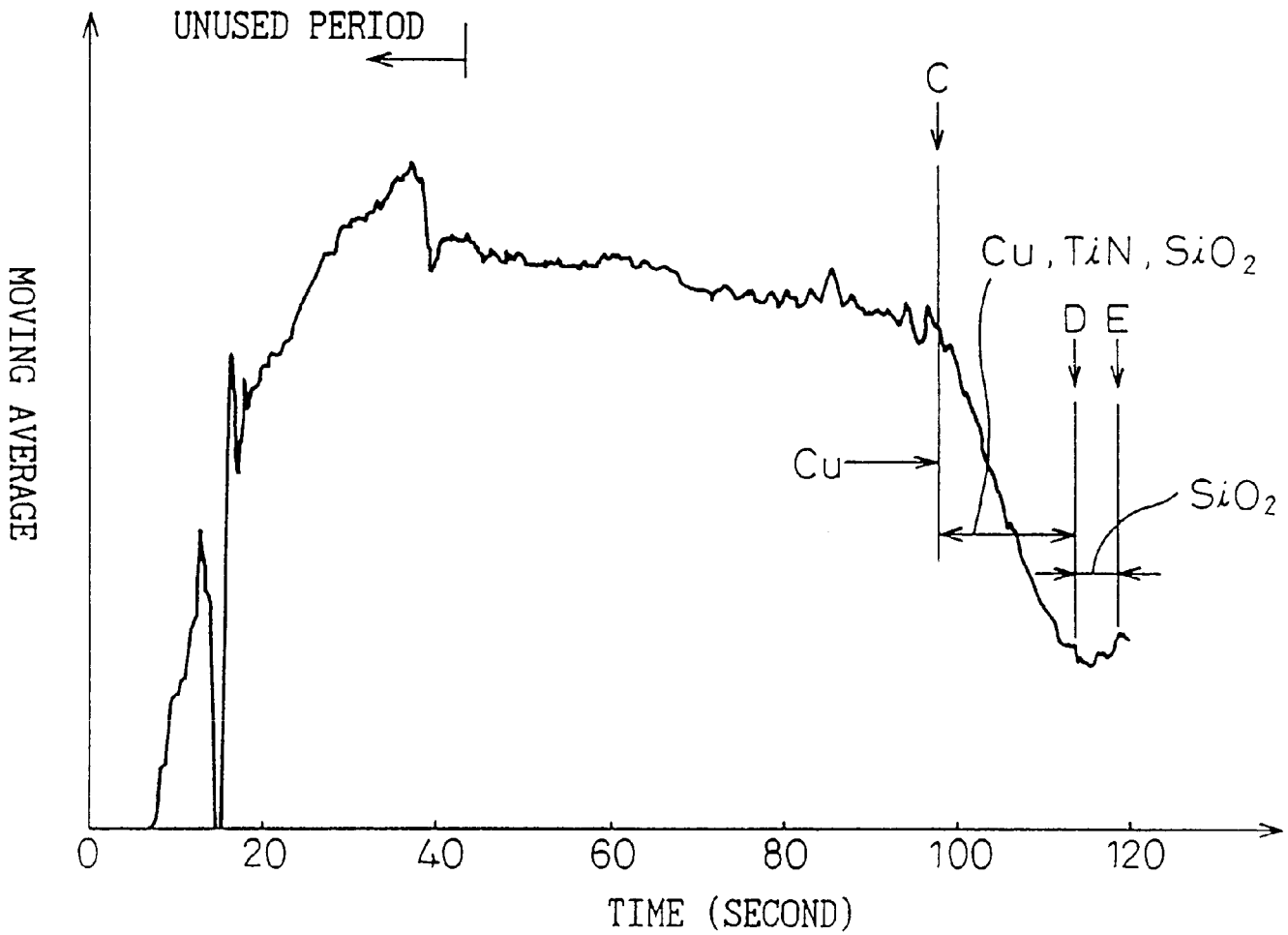
FIG. 8 is a diagram showing an example of the change in the moving average data obtained in the case where metal layer of FIG. 7 is polished.

As shown in FIG. 8, the moving average data undergoes such a change that the thickness appears to increase for some time after starting polishing. This can never occur, and therefore, as described above, the moving average data for this portion is removed. After this unstable period, the moving average data, though with some fluctuation, is gradually decreased. The reduction rate suddenly increases from the time point designated by C. This time point has been found to be when part of the Cu layer 4 disappears and the TiN layer 5 and the insulating material layer begin to appear. Further proceeding with the polishing, the reduction rate turns upward at the time point designated by D. This time point is when the surface TiN layer 5 disappears. Thus the polishing operation is continued from this time point for some time, and ended at the time point designated by E. The layer connecting holes are insulated in the absence of the Cu layer 4 and the TiN layer 5. Under this condition, the polishing operation is desirably terminated.

According to the first embodiment, the polishing stool and the wafer holding head (carrier) are rotated with the same period. This may not always be true. In such a case, the detection signal changes with a period which is a least common multiple of the two periods. Therefore, the moving average is desirably calculated by the number of times sampled during the period equal to the least common multiple of the two periods.

In order to prevent the damage to the wafer, however, the polishing stool 1 and the wafer holding head 10 may have somewhat different rotational periods, or an integer multiple of one of the periods is somewhat different from the other period. In the case where the magnitude of the components changing with respective rotational periods are almost equal to each other, the detection signal may change in a wavy manner. In the actual wafer polishing apparatus, however, the fluctuation of the detection signal is larger for the components changing with the same rotational period as the polishing stool 1. By calculating the moving average with an integer multiple of the number of times sampled per rotation of the polishing stool 1, therefore, the large fluctuation components can be considerably removed.

As described above, in the wafer polishing apparatus and the polishing quantity detection method according to the first aspect of the invention, the change in the wafer thickness (polishing quantity) during the polishing operation can be measured with high accuracy by simple means, and therefore the polishing quantity for the CMP apparatus can be controlled with high accuracy without reducing the throughput.

The CMP apparatus has come to require an improved processing efficiency such as the throughput and a reduced installation space with the increase in the performance requirement for the capability of polishing with high quality and high accuracy. In view of this, a plurality of polishing stools are provided so that a wafer load unit for supplying wafers to a plurality of the polishing stools may function also as a wafer unload unit for transporting the wafers from the plurality of the polishing stools. This configuration requires only one wafer load unit and one wafer unload unit for a plurality of polishing stools, and therefore can reduce the installation space. Also, as compared with the time required for polishing, the wafer is transported in a shorter time from the wafer load unit onto the polishing stools or from the polishing stools to the wafer unload unit. With this configuration, therefore, the processing efficiency is not reduced. Further, the polishing operation may be conducted by a combination of a rough polishing in which the polishing speed is high but the accuracy is not sufficient and a precision polishing in which the polishing speed is low but the polishing with high accuracy is possible. By employing the configuration described above, it is possible that one of a plurality of polishing stools performs the precision polishing while the other polishing stools perform the rough polishing. The second embodiment described below refers to the CMP apparatus as an example.

Figure 9:
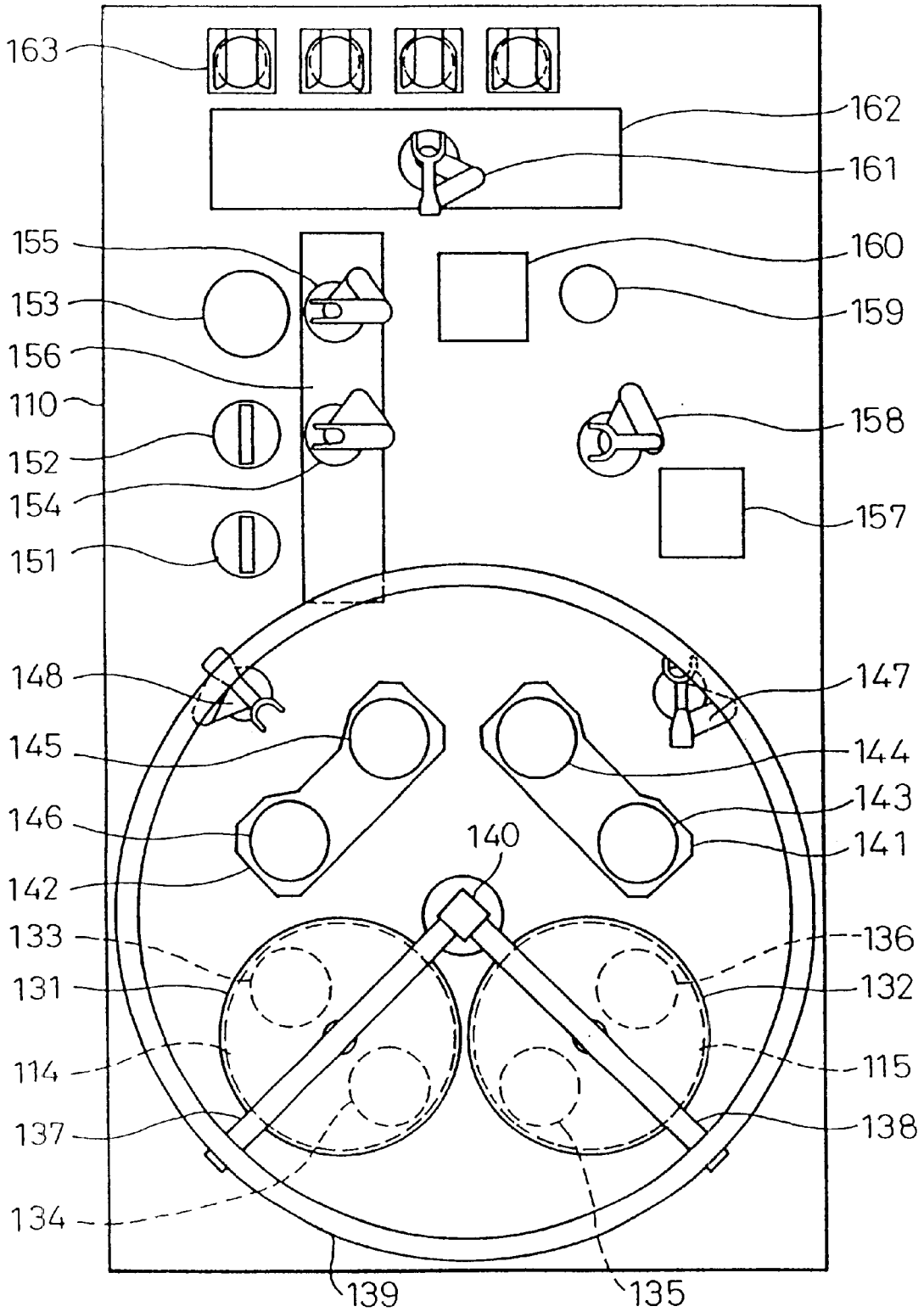
FIG. 9 is a top plan view showing a layout of a wafer polishing apparatus according to a second embodiment of the invention.

FIG. 9 is a top plan view showing a layout of the CMP apparatus according to a second embodiment of the invention. As shown, two polishing stools 114, 115 are included, and two wafer holding heads 131, 132 above them. The wafer holding heads 131, 132 have wafer holding rotational mechanisms 133, 134 and 135, 136, respectively. Each wafer holding rotational mechanism can hold a wafer by adsorption, and at the time of polishing, presses the wafer against the polishing cloth arranged on the polishing stools 114, 115 under air pressure. The wafer holding heads 131, 132 have an end thereof suspended by a rotational shaft 140 and the other end thereof suspended by rotational bars 137, 138 supported on an annular guide 139, and adapted to rotate with the rotation of the rotational bars 137, 138. As a result, the wafer holding heads 131, 132 can move over the wafer load unit 141 and the wafer unload unit 142.

The unpolished wafers encased in a plurality of the wafer cassettes 163 are picked up and placed on a relay table 159 by a transport arm 161 supported movably on the moving mechanism 162. The transport arm 158 transports the wafer placed on the relay table 159 to a first wafer thickness measuring tool 157. The first wafer thickness measuring tool 157 is for determining the thickness from the sum of outputs produced by bringing the probes of the two electric micrometers into contact with the two sides of the wafer. The thickness is measured desirably at a plurality of points on the wafer. The wafer of which the thickness is determined is placed on the receiving members 143, 144 on the wafer load unit 141 by the transport arm 147.

The polished wafers placed on the receiving members 145, 146 on the wafer unload unit 142 are placed on a first cleaner 151 by the transport arm 148. The wafer cleaned by the first cleaner 151 is placed on the adjoining second cleaner 152 by a transport arm 154. In this way, the polished wafer is cleaned in two stages. The wafer cleaned in the second stage by the second cleaner 152 is dried by being placed on a dryer 153 by a transport arm 155. The transport arms 154, 155 are movably supported on the moving mechanism 156. The wafer that has been dried by the dryer 153 is transported to a second wafer thickness measuring tool 160 by a transport arm 161, and the thickness thereof after polishing is measured at the same points as the in the first wafer thickness measuring tool 157. The difference between the thickness measured by the first wafer thickness measuring tool 157 and the thickness measured by the second wafer thickness measuring tool 160 is the polishing quantity. The wafer the thickness of which has been measured is returned to the wafer cassette 163 by a transport arm 161. The transport arm 161 is movably supported on the moving mechanism 162.

Figure 10:
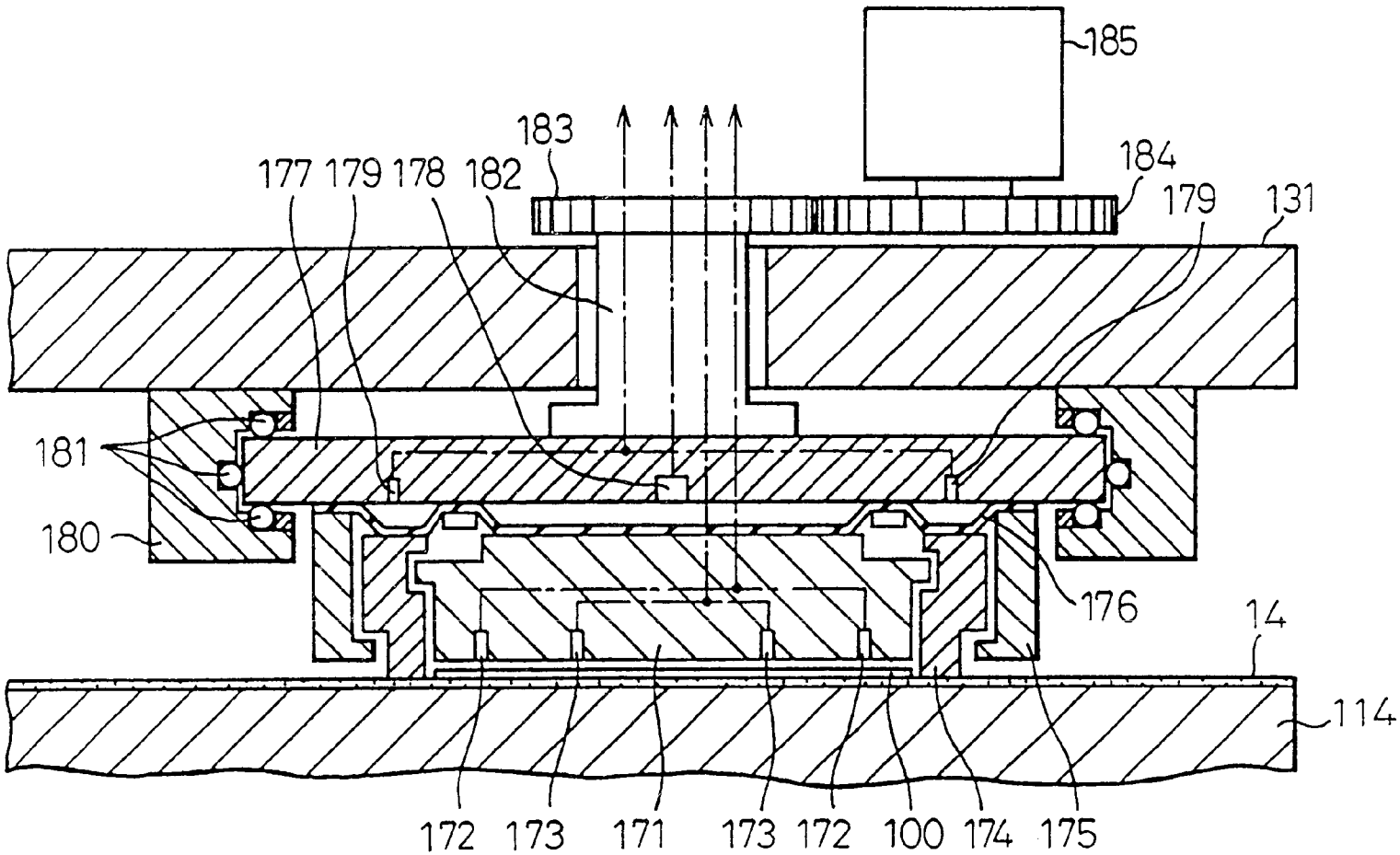
FIG. 10 is a diagram showing a wafer holding rotational mechanism for a wafer polishing apparatus according to the second embodiment.

The polishing stools 114, 115 and the wafer holding rotational mechanisms 133, 134 and 135, 136 of the wafer holding heads 131, 132 can have the same configuration as the prior art. In the case under consideration, however, as in the first embodiment, a wafer holding rotational mechanism is employed having such a structure that the wafer is pressed against the polishing cloth under a predetermined air pressure. FIG. 10 is a diagram showing a configuration of the wafer holding rotational mechanism 133 of the wafer holding head 131 according to the second embodiment.

As shown, the wafer holding rotational mechanism 133 includes a carrier member 171, a polishing surface adjusting ring 174, a guide ring 175, a rotary base 177, a rotary guide plate 180, a rotary shaft 182 having a slip ring, gears 183, 184 and a motor 185. The carrier member 171 has an air outlet 172 for discharging the air and an adsorption port 173 impressed with a negative pressure. The air pressure discharged from the air outlet 172 presses the the wafer 100 against the polishing cloth 14, and by applying a negative pressure to the adsorption port 173, the wafer 100 is adsorbed to and held at the carrier member 171 by the negative pressure imparted to the adsorption port 173. The polishing surface adjusting ring 174 is brought into contact with the polishing cloth 14 under a predetermined pressure, and prevents the polishing irregularities from occurring by assuring a uniform internal state of the polishing cloth 14. When moving the wafer holding head 131 upward, on the other hand, the carrier member 171 is held, and when pressing the wafer 100 against the polishing cloth 14, the carrier member 171 is released from a mutually restrained state. When moving the wafer holding head 131 upward, the guide ring 175 holds the polishing surface adjusting ring 174, while when the wafer 100 is pressed against the polishing cloth 14, the polishing surface adjusting ring 174 is released from a mutually restrained state.

A rubber sheet 176 is interposed between the rotary base 177, the carrier member 171 and the polishing surface adjusting ring 174. By applying a predetermined air pressure from the air outlet 178, the carrier member 171 is pushed down under predetermined pressure, while by applying a predetermined air pressure from the air outlet 179, the polishing surface adjusting ring 174 is pushed down under predetermined pressure. When the carrier member 171 is pushed down under the air pressure from the air outlet 178, the space between the carrier member 171 and the wafer 100 is changed, so that in spite of the air pressure being the same from the air outlet 172, the wafer 100 can be pressed against the polishing cloth 14 under a different pressure.

The rotary base 177 is rotatably supported on the rotary guide plate 180 through a bearing 181, and when the motor 185 starts, begins to be rotated through the gear 184 and the gear 183 of the rotary shaft 182.

Figure 11:
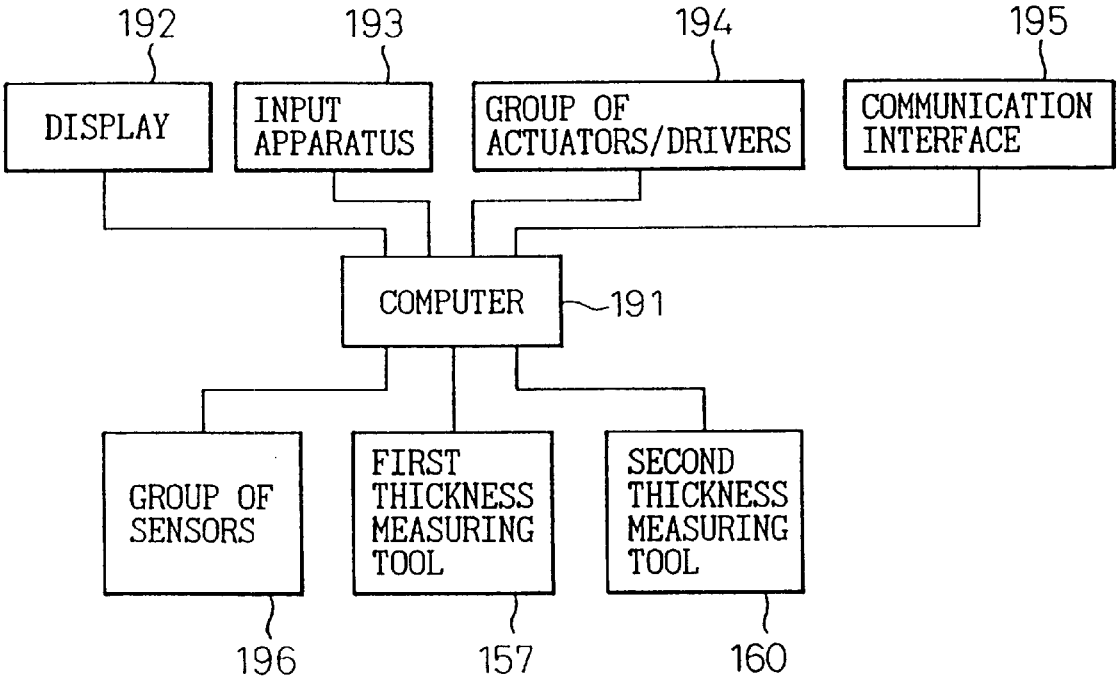
FIG. 11 is a diagram showing a configuration of a control unit of a wafer polishing apparatus according to the second embodiment.

FIG. 11 is a diagram showing a configuration of the control unit of the CMP apparatus according to the second embodiment. As shown, the control unit includes a computer 191 which is connected to a display unit 192, an input unit 193 such as a keyboard, a group of actuators/drivers 194 such as a motor and an air valve, a communication interface 195, a group of sensors 196, a first wafer thickness measuring tool 157 and a second wafer thickness measuring tool 160. This control unit is connected to a host computer for managing the whole IC production process through the communication interface 195. The operator designates a polishing quantity, etc. corresponding to the wafer number by way of the input unit 193 while watching the display unit 192. In response, the computer 191 drives the actuators/drivers 194 while monitoring the detection signal of the sensors 196, and thus controls the CMP apparatus in such a manner as to sequentially polish the wafers encased in the wafer cassettes 163.

In the CMP apparatus according to the second embodiment, the polishing quantity is controlled by calculating the polishing time corresponding to the polishing quantity designated according to a model of the polishing time and the polishing quantity produced in advance and by conducting the polishing operation for the calculated polishing time.

Figure 12A:
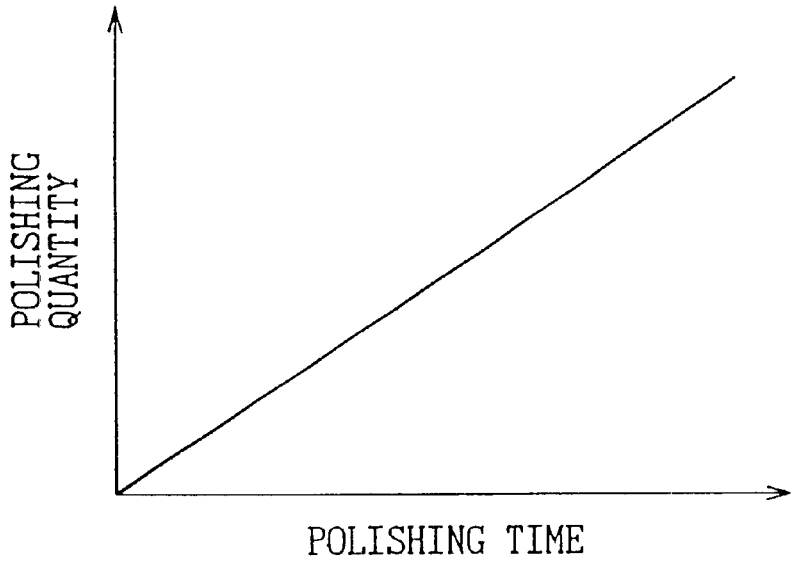
FIGS. 12A and 12B are diagrams for explaining a polishing model and the correction of the polishing model according to the second embodiment.
Figure 12B:
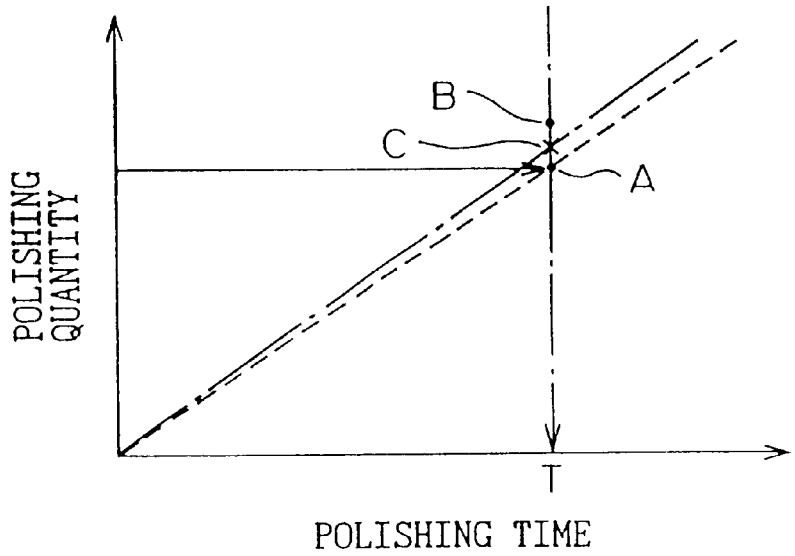

The control of the polishing quantity will be explained. FIGS. 12A and 12B are diagrams for explaining a model of the polishing time and the polishing quantity and the correction thereof according to this embodiment. A dummy wafer having the same film structure is polished under the same polishing conditions including the polishing cloth, the slurry, pressure and the rotational speed in advance, and the thickness before and after polishing is measured. The measurement is conducted a plurality of the polishing times, and the relation is determined between the polishing time and the polishing quantity as shown in FIG. 12A. The polishing time and the polishing quantity are shown to be proportional to each other, but this is not necessarily so. The computer 191 stores this relation between the polishing time and the polishing quantity and, in accordance with the designated polishing quantity, calculates the required polishing time. Thus, by conducting the polishing operation for the calculated length of time, the polishing is completed at the designated polishing quantity.

The relation between the polishing time and the polishing quantity shown in FIG. 12A, however, changes with the change in the conditions such as the temperature and the wear of the polishing cloth which may occur during the polishing operation. The change of the conditions such as the temperature and the wear of the polishing cloth is unavoidable. In most cases, however, the relation between the polishing time and the polishing quantity remains substantially the same and only the change rate becomes different in spite of the change which may occur in the conditions during the polishing operation. In the case of FIG. 12A where the polishing time and the polishing quantity change in proportion to each other, for example, only the inclination of the curve changes. Thus, the computer 191 fetches and stores the measurement of the wafer thickness by the first wafer thickness measuring tool 157 before polishing, and fetches the measurement of the thickness of the polished wafer by the second wafer thickness measuring tool 160 after polishing, and thus calculates the difference. This difference corresponds to the polishing quantity.

In the case where the polishing quantity A is designated for the polishing operation as shown in FIG. 12B, for example, the polishing time T is calculated based on the relation between the polishing time and the polishing quantity indicated by dashed line. Since the actual polishing quantity is B after conducting the polishing operation for the time T, the difference B−A develops. According to this embodiment, the relation between the polishing time and the polishing quantity is corrected in such a manner as to assure the polishing quantity of (A+B)/2=C for the polishing time T, and the polishing time for the next polishing session is determined based on this corrected relation. This correction is made taking into consideration the measurement error of the polishing quantity calculated from the wafer thickness measurement before and after polishing. As far as this measurement error is negligibly small, the relation between the polishing time and the polishing quantity may be corrected so that the polishing quantity is B for the polishing time T.

Figure 13A:
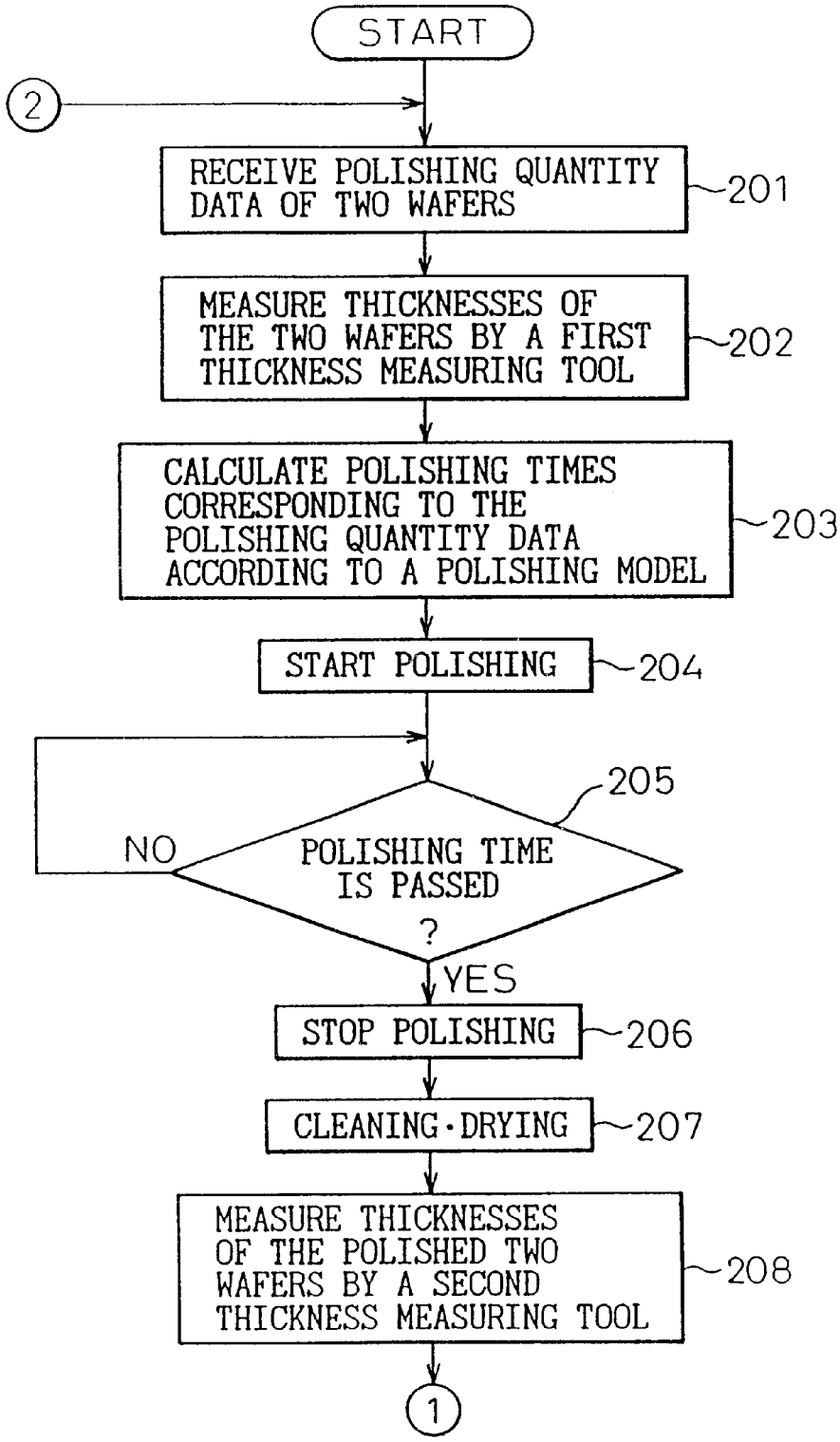
FIGS. 13A and 13B are flowcharts showing the processing operation according to the second embodiment.
Figure 13B:
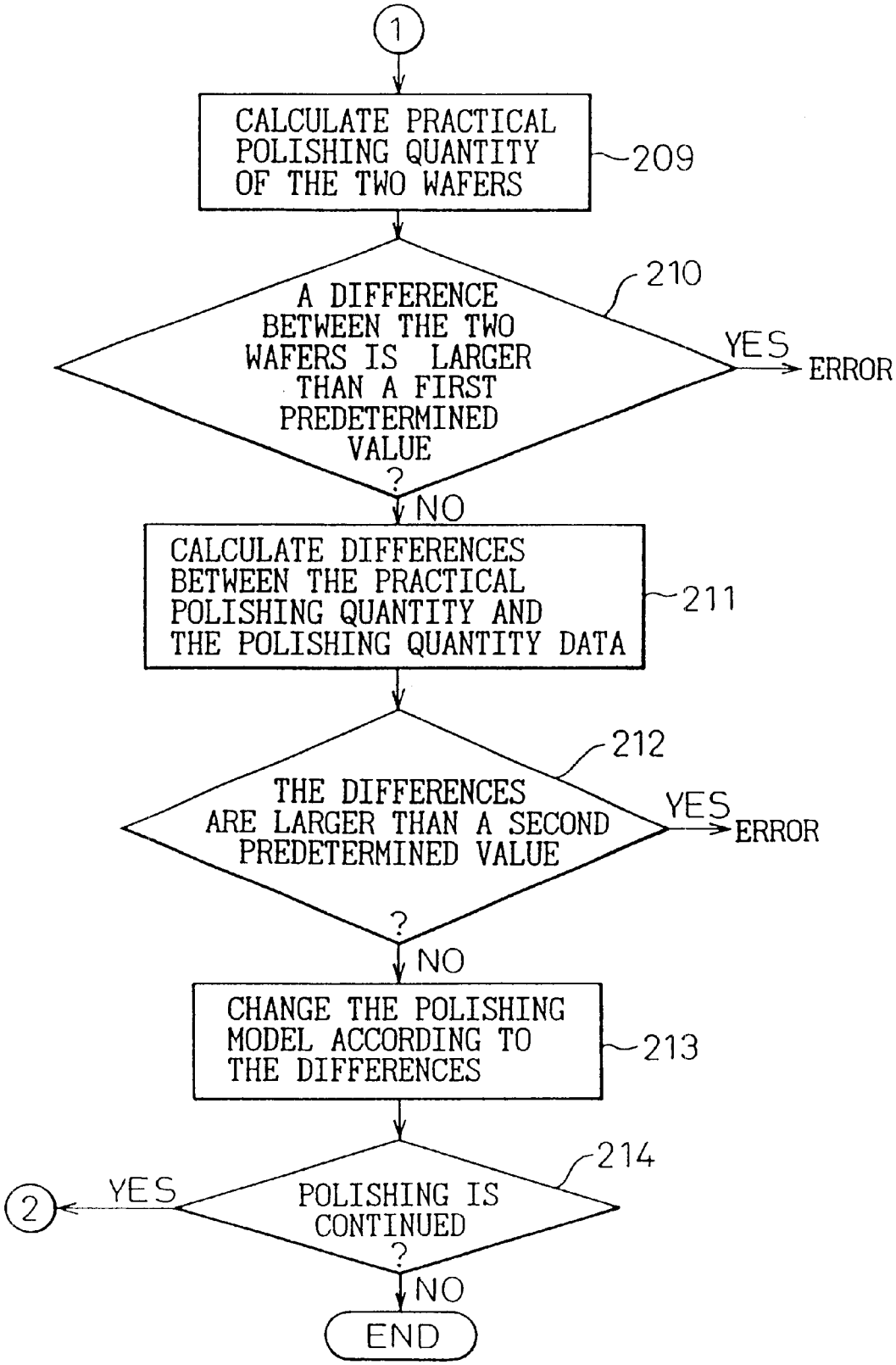

FIGS. 13A and 13B are flowcharts showing the processing according to this embodiment.

According to this embodiment, each of the wafer holding heads 131, 132, in which two wafers are polished at the same time, receives the polishing quantity data for the two wafers from the communication interface 195 or the input unit 193 in step 201. As far as the wafers are processed the same way, the polishing quantity is the same, and therefore step 201 may be executed only initially.

In step 202, the thickness of the two wafers before polishing is measured by the first wafer thickness measuring tool 157. In step 203, the polishing time corresponding to the polishing quantity data is calculated from a polishing model. In step 204, the polishing is started, and in step 205, it is determined whether the polishing time has elapsed or not.

Upon the lapse of the polishing time, the polishing is stopped in step 206, the wafer is cleaned and dried in step 207, the thickness of the two wafers after polishing is measured by the second wafer thickness measuring tool 160 in step 208, and the polishing quantity of the two wafers is calculated in step 209.

In step 210, it is determined whether the difference of the polishing quantity between the two wafers is not less than a first predetermined value or not. In the case where the difference of the polishing quantity between the two wafers is not less than the first predetermined value, the polishing cannot be continued, and therefore an error signal is generated. In response, the set conditions including the pressure, etc. of the two wafer holding rotational mechanisms are corrected.

In step 211, the difference between the polishing quantity and the polishing quantity data is calculated. In the process, the average of the polishing quantity of the two wafers is calculated as a polishing quantity, for example. In step 212, it is determined whether the difference between the polishing quantity and the polishing quantity data is not less than a second predetermined value or not. Under normal conditions, the difference may increase gradually but never suddenly. In the case where the difference is considerable, therefore, an error is considered to have occurred, and an error signal is generated. In step 213, the polishing model is corrected by the method described with reference to FIG. 12B in accordance with the difference between the polishing quantity and the polishing quantity data. In step 213, it is determined whether there are any wafers remaining to be polished under the same conditions. If the answer is yes, the process returns to step 201, otherwise the process is ended.

The first and second wafer thickness measuring tools measure the thickness at a plurality of points of a single sheet of wafer. In the case where the difference of the polishing quantity between these points is considerable, an error may be considered to have occurred, and an error signal is generated.

Figure 14:
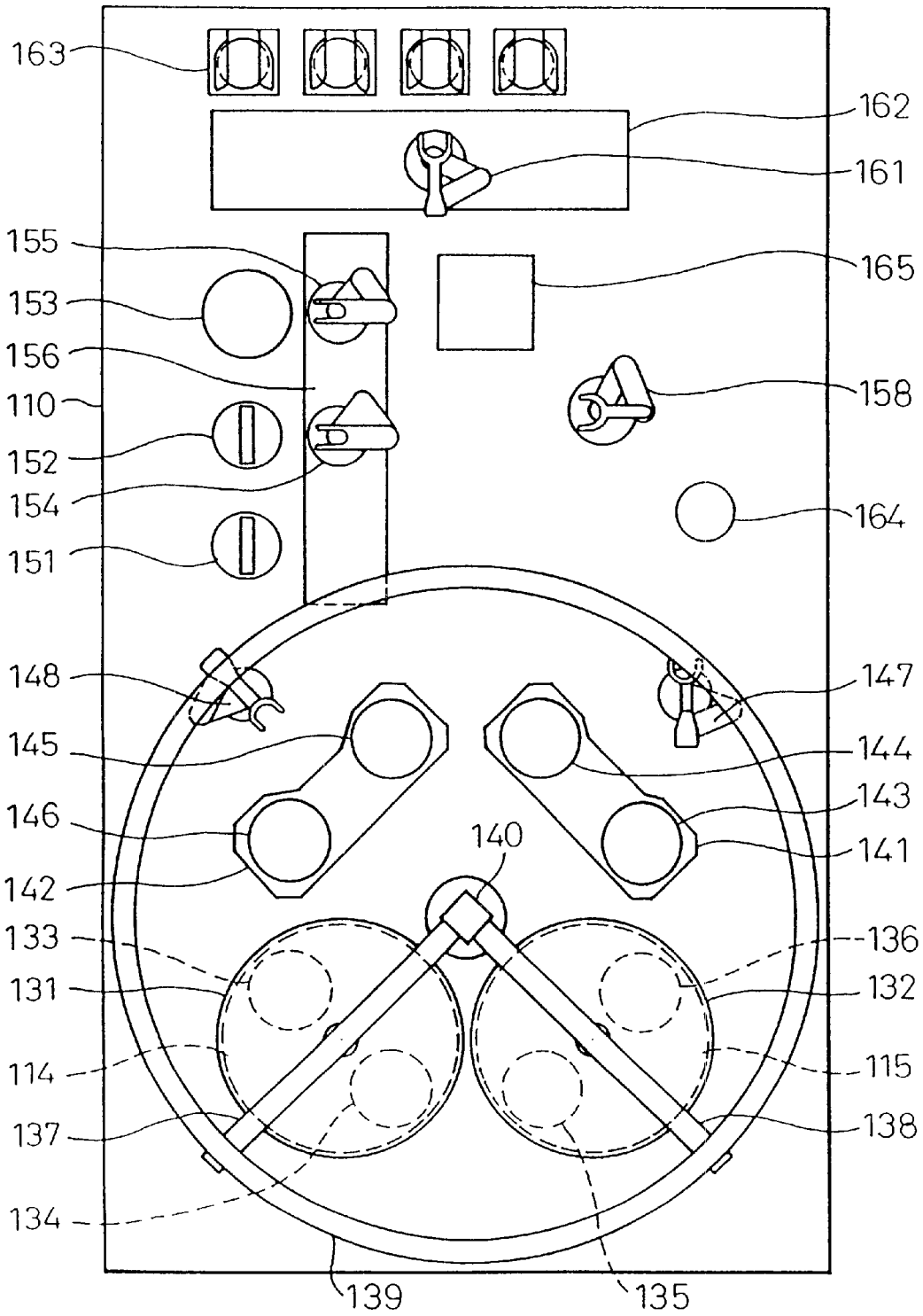
FIG. 14 is a top plan view showing a layout of a wafer polishing apparatus according to a third embodiment of the invention.

FIG. 14 is a top plan view showing a layout of the CMP apparatus according to a third embodiment of the invention. This embodiment is different from the second embodiment in that the first wafer thickness measuring tool 157 is replaced by a relay table 164, the relay table 159 is removed, and the second wafer thickness measuring tool 160 is replaced by an oxide insulating film thickness measuring tool 165. This CMP apparatus is used for polishing the oxide insulating film, the thickness of the oxide insulating film is measured by the oxide insulating film thickness measuring tool 165 before and after polishing, and the polishing quantity is calculated from the difference in thickness of the oxide insulating film before and after polishing.

Figure 15A:
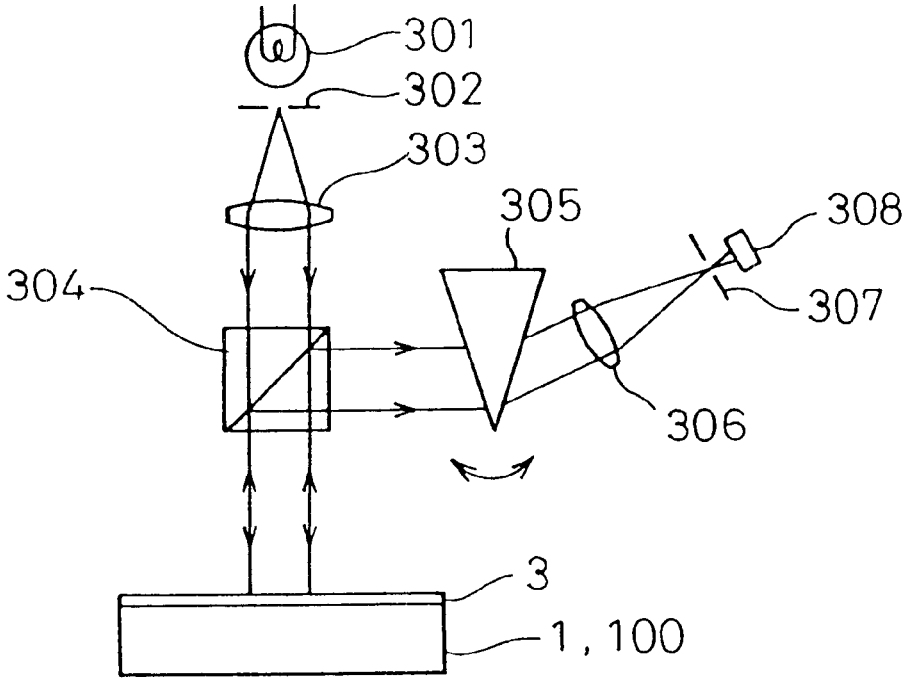
FIGS. 15A and 15B are diagrams for explaining the operating principle of a thickness measuring tool for an oxide insulating film used in the third embodiment.
Figure 15B:
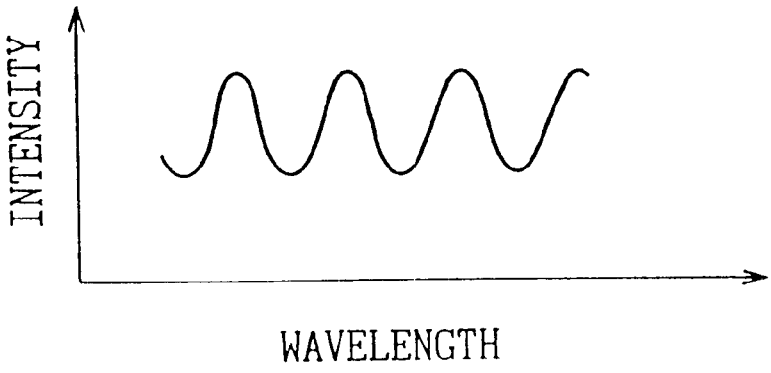

FIGS. 15A and 15B are diagrams for explaining the measurement principle of the oxide insulating film thickness measuring tool 65. FIG. 15A shows a basic configuration, and FIG. 15B a detection signal produced. As shown in FIG. 15A, the light from a white light source 301 is converted into parallel light by a lens 303 through a slit 302. Part of this parallel light enters at right angles to a wafer 100 (substrate 1) formed with the oxide insulating film 3 through a beam splitter 304. The oxide insulating film 3 is about several hundred nm thick, and the light having a wavelength twice (or multiple thereof) the optical film thickness, when reflected, increases the intensity thereof by interference. This reflected light is split by the beam splitter 304, passed through a prism 305 and further through lens 306. The light passed through a slit 307 is detected by a light detector 308. The light passed through the prism 305 has a different direction of refraction depending on the wavelength, and only the light having a narrow wavelength range passes through the slit 307. Specifically, only the light of a predetermined wavelength is detected by the light detector 308. With the rotation of the prism 305, the wavelength of the light passing through the slit 307 changes. Thus, the light detector 308 detects different intensities of light of different wavelengths with the rotation of the prism 305. As described above, the components of the light having a wavelength twice (or multiple of) the optical film thickness increases the intensity thereof by interference when reflected from the wafer 100. Thus, the detection signal as shown in FIG. 15B is produced. Upon detection of a wavelength associated with the peak signal amplitude, therefore, the optical film thickness can be measured. This measurement, combined with the refractive index of the oxide insulating film 3, can determine the film thickness.

Figure 16A:
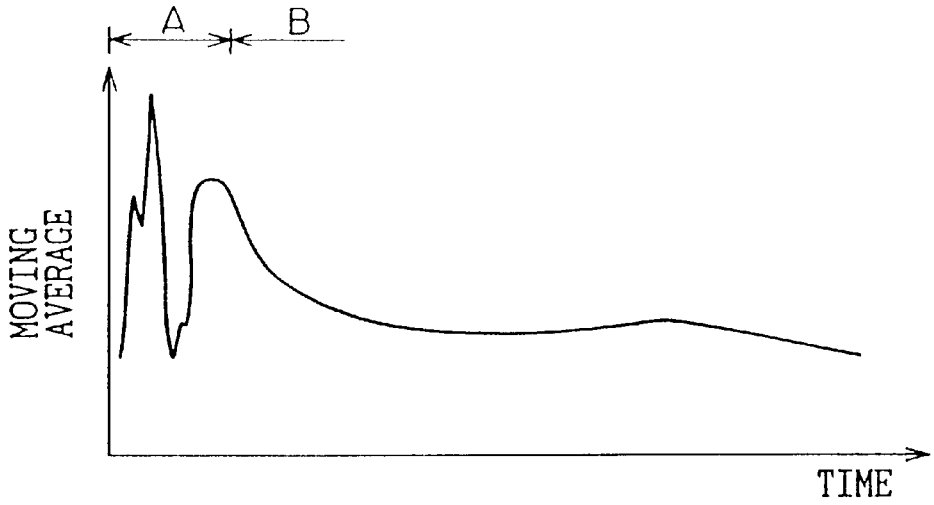
FIGS. 16A to 16C are diagrams showing a wafer thickness detection signal, a polishing model for correction thereof and correction data according to the third embodiment.
Figure 16B:
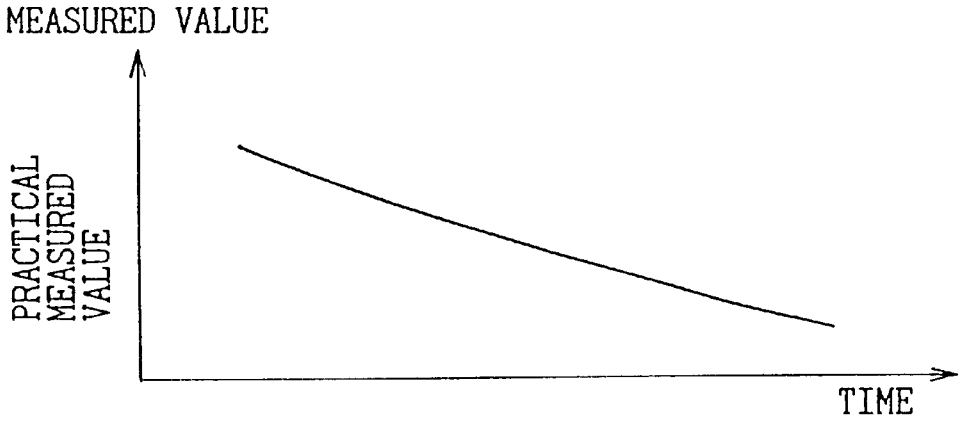
Figure 16C:
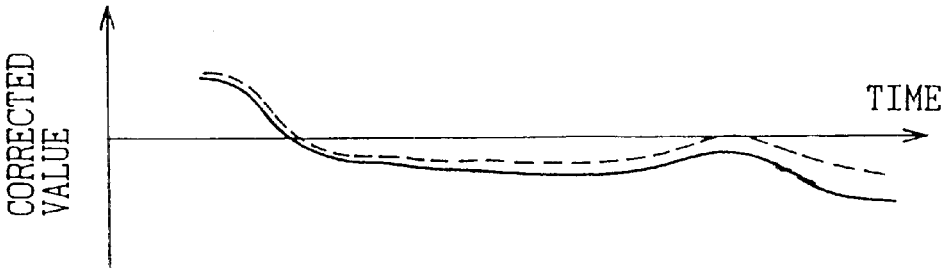

The wafer holding rotational mechanisms 33 to 36, on the other hand, have the same configuration as the corresponding mechanism included in the first embodiment shown in FIG. 3. Specifically, the wafer holding rotational mechanisms 33 to 36 include a detector for detecting the amount corresponding to the change in wafer thickness during the polishing operation, and the detection signal as shown in FIG. 16A is produced for the practical polishing quantity shown in FIG. 16B. As in the first embodiment, a correction model shown by solid line in FIG. 16C was produced and has been found to fluctuate due to various factors. For this reason, even in the case where the polishing operation is stopped at the time point when the value after correcting the moving average data reaches a-predetermined value, the practical polishing quantity sometimes fails to reach the desired value. In view of this, according to the third embodiment, the correction model is changed in accordance with the predetermined polishing quantity and the practical polishing quantity. A comparatively satisfactory result is obtained by this change when the corrected value at each polishing time is gradually displaced in such a manner that the corrected value curve shown in FIG. 16C, for example, has zero displacement at the polishing start time and is displaced by the difference between the predetermined polishing quantity and the practical polishing quantity at each polishing time point.

What is claimed is:

1. A wafer polishing apparatus comprising:

a rotatable polishing stool having a polishing cloth on a surface thereof and having a polishing tool rotational shaft;

a carrier rotated about a rotational shaft parallel to but different from the polishing tool rotational shaft for bringing a wafer into contact with said polishing cloth under a predetermined pressure;

a pad arranged around said wafer in such a manner as to contact said polishing cloth under a predetermined pressure;

a detector for detecting change in relative positions of the back of said wafer or said carrier and said pad, the detector providing a detection signal;

an operating unit for computing a computed polishing quantity by processing the detection signal of said detector; and a control unit for controlling polishing operation in accordance with the computed polishing quantity;

said operating unit including:

a sampling unit for sampling the detection signal of said detector with such a sampling period that the number of times sampled per rotation of said polishing stool is plural, the sampling unit providing sampling data;

a moving average calculating unit for calculating moving average data by averaging the sampling data in the number equal to an integer multiple of the number of times sampled per rotation; and a polishing quantity computing unit for computing the polishing quantity from said moving average data.

2. The wafer polishing apparatus according to claim 1, wherein said polishing quantity computing unit computes said polishing quantity except for the moving average data within a predetermined time from a polishing operation start time.

3. The wafer polishing apparatus according to claim 1, wherein said polishing quantity computing unit includes:

a corrected data storage unit for storing corrected data calculated from the polishing quantity computed in said computing unit when said wafer is polished and a practical measured value of the thickness of said wafer actually measured by another measuring tool before and after polishing; and a correcting unit for correcting the computed polishing quantity computed in said polishing quantity computing unit based on said corrected data and outputting said corrected quantity as a polishing quantity.

4. The wafer polishing apparatus according to claim 1, wherein said carrier includes a pressure fluid layer forming unit for forming a pressure fluid layer with the back of said wafer, and said wafer is pressed against said polishing cloth under a predetermined pressure by said pressure fluid layer.

5. The wafer polishing apparatus according to claim 4, wherein said control unit operates in such a manner that:

upon an insulating material layer being formed on the surface of the wafer, a metal layer being formed further on said insulating material layer, and said wafer being polished until said metal layer on said insulating material layer is removed, it is determined that the time point when said moving average data suddenly decreases as compared with a preceding change and then starts increasing is the time point when said metal layer on said insulating material layer is removed, and after further continuing the polishing operation for a predetermined time, the polishing is stopped.

6. The wafer polishing apparatus according to claim 1, further comprising:

a temperature sensor for detecting the temperature proximate to said detector, and a detector temperature characteristic correcting unit for correcting the detection signal of said detector based upon a detected temperature from the temperature sensor.

7. The wafer polishing apparatus according to claim 1, further comprising:

a temperature sensor for detecting the temperature of at least a part of the member between a detector detection portion and the back of said wafer or a portion of said carrier facing said wafer;

a temperature sensor for detecting the temperature of at least a part of the member between the detector detection portion and a portion of said pad facing said polishing cloth; and a thermal expansion correcting unit for calculating the difference of thermal expansion at the detector detection portion based on the temperature detected by said temperature sensors, and correcting the detection signal of said detector by the difference of the thermal expansion.

8. A wafer polishing apparatus comprising:

a rotatable polishing stool having a polishing cloth on a surface thereof and having a polishing tool rotational shaft;

a carrier rotated about a rotational shaft parallel to but different from the polishing tool rotational shaft for bringing a wafer into contact with said polishing cloth under a predetermined pressure;

a pad arranged around said wafer in such a manner as to contact said polishing cloth under a predetermined pressure;

a detector for detecting change in relative positions of the back of said wafer or said carrier and said pad, the detector providing a detection signal;

an operating unit for computing a computed polishing quantity by processing the detection signal of said detector;

a control unit for controlling the polishing operation in accordance with the computed polishing quantity;

a temperature sensor for detecting the temperature proximate to said detector and a detector temperature characteristic correcting unit for correcting the detection signal of said detector based upon a detected temperature from the temperature sensor.

9. A wafer polishing apparatus comprising:

a rotatable polishing stool having a polishing cloth on a surface thereof and having a polishing tool rotational shaft;

a carrier rotated about a rotational shaft parallel to but different from the polishing tool rotational shaft for bringing a wafer into contact with said polishing cloth under a predetermined pressure;

a pad arranged around said wafer in such a manner as to contact said polishing cloth under a predetermined pressure;

a detector for detecting change in relative positions of the back of said wafer or said carrier and said pad and providing a detection signal;

an operating unit for computing a computed polishing quantity by processing the detection signal of said detector; and a control unit for controlling polishing operation in accordance with the computed polishing quantity;

a temperature sensor for detecting the temperature of at least a part of the member between a detector detection portion and the back of said wafer or a portion of said carrier facing said wafer;

a temperature sensor for detecting the temperature of at least a part of the member between the detector detection portion and a portion of said pad facing said polishing cloth; and a thermal expansion correcting unit for calculating the difference of thermal expansion at the detector detection portion based on the temperature detected by said temperature sensors, and correcting the detection signal of said detector by the difference of the thermal expansion.

10. A polishing quantity detecting method for a wafer polishing apparatus, the wafer polishing apparatus including:

a rotatable polishing stool having a polishing cloth on the surface thereof and having a polishing tool rotational shaft;

a carrier rotated about a rotational shaft parallel to but different from the polishing tool rotational shaft for bringing a wafer into contact with said polishing cloth under a predetermined pressure;

a pad arranged around said wafer in such a manner as to contact said polishing cloth under a predetermined pressure; and a detector for detecting the change in the relative positions of the back of said wafer or said carrier and said pad and providing a detection signal;

said method comprising:

sampling the detection signal of said detector with a sampling period for which the number of times sampled per rotation of said polishing stool is plural;

calculating moving average data by averaging the sampling data in the number equal to an integer multiple of the number of time sampled per rotation; and computing a computed polishing quantity from said moving average data.

11. The polishing quantity detection method according to claim 10 wherein, said computing further includes computing said polishing quantity by excluding the moving average data within a predetermined time from a machining start time.

12. The polishing quantity detection method according to claim 10, wherein said computing further includes:

storing correction data calculated from the computed polishing quantity and a practical measured value of the thickness of said wafer measured by another measuring tool before and after the polishing; and correcting the computed polishing quantity based on said correction data and outputting said polishing quantity.

13. The polishing quantity detection method according to claim 10, wherein upon an insulating material layer being formed on the surface of said wafer, a metal layer being formed further on said insulating material layer, and said wafer being polished until said metal layer on said insulating material layer is removed, determining that a time point when said moving average data suddenly decreases as compared with a preceding change and then starts increasing is a time point when said metal layer on said insulating material layer is removed.

14. A wafer polishing apparatus comprising:

a rotatable polishing stool with a polishing cloth arranged on the surface thereof;

a wafer holding head rotated while holding said wafer and pressing the surface of said wafer against said polishing cloth;

a control unit operated in such a manner as to perform the polishing operation by a quantity corresponding to designated polishing quantity data in accordance with a polishing model;

a polishing quantity measuring unit for measuring a practical measured value of the polishing quantity of the wafer polished; and a polishing model correcting unit for correcting said polishing model in accordance with the difference between said practical measured value of the polishing quantity measured by said polishing quantity measuring unit and said polishing quantity data.

15. The wafer polishing apparatus according to claim 14, wherein said polishing quantity measuring unit includes a wafer thickness measuring tool for measuring the thickness of said wafer, and the practical measured value of said polishing quantity is calculated from the difference of the wafer thickness before and after the polishing.

16. The wafer polishing apparatus according to claim 14, wherein said polishing quantity measuring unit includes a film thickness measuring tool for detecting the thickness of an oxide insulating film formed on said wafer, and the practical measured value of said polishing quantity is calculated from the difference of the thickness of said oxide insulating film before and after the polishing.

17. The wafer polishing apparatus according to claim 14, wherein said polishing model indicates the change of the polishing quantity of said wafer with respect to polishing time.

18. The wafer polishing apparatus according to claim 14, further comprising:

a displacement measuring tool for detecting a change of relative positions of the surface of said polishing cloth and the back of said wafer or said wafer holding head;

wherein said polishing model is based on an output of said displacement measuring tool and the practical measured value for correcting the output of said displacement measuring tool.

19. The wafer polishing apparatus according to claim 14, wherein said polishing model correcting unit corrects said polishing model in such a manner as to produce an intermediate value between the practical measured value of the polishing quantity and said polishing quantity data.

* * * * *